US010455311B2

(12) United States Patent
Magariyachi et al.

(10) Patent No.: US 10,455,311 B2
(45) Date of Patent: Oct. 22, 2019

(54) IN-THE-EAR DEVICE

(71) Applicant: SONY CORPORATION, Tokyo (JP)

(72) Inventors: Tetsu Magariyachi, Kanagawa (JP); Toru Nakagawa, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/314,623

(22) PCT Filed: Apr. 1, 2015

(86) PCT No.: PCT/JP2015/060384
§ 371 (c)(1),
(2) Date: Nov. 29, 2016

(87) PCT Pub. No.: WO2015/194234
PCT Pub. Date: Dec. 23, 2015

(65) Prior Publication Data

US 2017/0195766 A1 Jul. 6, 2017

(30) Foreign Application Priority Data

Jun. 18, 2014 (JP) ..... 2014-124950

(51) Int. Cl.
*H04R 1/10* (2006.01)
*H04R 5/027* (2006.01)
(Continued)

(52) U.S. Cl.
CPC ..... *H04R 1/1016* (2013.01); *H04R 1/1075* (2013.01); *H04R 5/027* (2013.01);
(Continued)

(58) Field of Classification Search
CPC .. H04R 1/1016; H04R 25/604; H04R 25/652; H04R 2225/025
See application file for complete search history.

(56) References Cited

U.S. PATENT DOCUMENTS 2,325,590 A * 7/1943 Carlisle ..... H04R 11/06 381/322
2,487,038 A * 11/1949 Baum ..... A61F 11/08 128/867
(Continued)

FOREIGN PATENT DOCUMENTS

CH 648172 A5 * 2/1985 ..... H04R 25/65
DE 1487272 A1 * 3/1969 ..... H04R 25/652
(Continued)

OTHER PUBLICATIONS

International Search Report and Written Opinion of PCT Application No. PCT/JP2015/060384, dated May 19, 2015, 4 pages of English Translation and 5 pages of ISRWO.
(Continued)

*Primary Examiner* — Curtis A Kuntz
*Assistant Examiner* — Ryan Robinson
(74) *Attorney, Agent, or Firm* — Chip Law Group

(57) ABSTRACT

An in-the-ear device such as a binaural microphone and an earphone is provided. An in-the-ear device 300 is used while being inserted into a human ear (external auditory canal), examples of which include the microphone and the earphone. This in-the-ear device 300 includes an in-the-ear device main body unit 310 substantially round column-shaped and a cylindrical inner side insertion unit 320 provided to protrude from an end surface of the in-the-ear device main stomach body unit 310 on an inner side. The in-the-ear device main body unit 310 is inserted closer to the inside than a first curve of the external auditory canal. As will be described later, an end surface of the in-the-ear device main body unit 310 on an outer side forms a surface substantially same as that of a cavum conchae while being worn. In addition, in the inner side insertion unit 320, the in-the-ear device main body unit 310 is provided to protrude closer to the inner side than the first curve of the external
(Continued)

auditory canal in order to be along the external auditory canal.

11 Claims, 25 Drawing Sheets

(51) Int. Cl.
*H04R 1/08* (2006.01)
*H04R 25/00* (2006.01)

(52) U.S. Cl.
CPC ..... *H04R 1/08* (2013.01); *H04R 25/55* (2013.01); *H04R 25/65* (2013.01); *H04R 2225/025* (2013.01)

(56) References Cited

U.S. PATENT DOCUMENTS 2,971,065 A * 2/1961 Busse ..... H04R 25/456 381/104
4,069,400 A * 1/1978 Johanson ..... H04R 25/60 381/322
4,585,089 A * 4/1986 Topholm ..... H04R 25/65 181/130
4,716,985 A * 1/1988 Haertl ..... H04R 25/65 181/130
4,969,534 A * 11/1990 Kolpe ..... H04R 25/456 181/130
5,357,576 A * 10/1994 Arndt ..... H04R 25/604 381/328
6,144,750 A * 11/2000 Levin ..... H04R 25/652 181/129
6,354,990 B1 * 3/2002 Juneau ..... H04R 25/658 600/25
7,804,975 B2 * 9/2010 Meier ..... H04R 25/652 381/322
7,876,919 B2 * 1/2011 Ram ..... H04R 1/086 381/322
8,774,434 B2 * 7/2014 Zhao ..... H04R 25/656 381/328
2005/0078844 A1 * 4/2005 Von Ilberg ..... H04R 25/04 381/322
2011/0274296 A1 * 11/2011 Wai ..... H04R 1/1016 381/121
2014/0193022 A1 7/2014 Koizumi
2016/0317352 A1 * 11/2016 Blumer ..... A61F 11/08

FOREIGN PATENT DOCUMENTS

JP 2013-017150 A 1/2013
WO 2013/005784 A1 1/2013

OTHER PUBLICATIONS

International Preliminary Report on Patentability of PCT Application No. PCT/JP2015/060384, dated Dec. 29, 2016, 5 pages of English Translation and 3 pages of IPRP.

* cited by examiner

IN-THE-EAR DEVICE

CROSS REFERENCE TO RELATED APPLICATIONS

This application is a U.S. National Phase of International Patent Application No. PCT/JP2015/060384 filed on Apr. 1, 2015, which claims priority benefit of Japanese Patent Application No. JP 2014-124950 filed in the Japan Patent Office on Jun. 18, 2014. Each of the above-referenced applications is hereby incorporated herein by reference in its entirety.

TECHNICAL FIELD

A technology to be disclosed in the present description relates to an in-the-ear device used while being worn on a human ear such as a binaural microphone or an earphone.

BACKGROUND ART

Among approaches for picking up a sound, a method for recording a sound with microphones attached to near both ears of a human head or a dummy head is generally called "binaural sound recording". Simultaneously recording sound space information on a particular place where a sound is recorded is considered as a primary advantage of the binaural sound recording. When an audio signal obtained through the binaural sound recording is played back with a pair of headphones, an effect as if a sound is heard in an environment where the sound recording has been carried out can be obtained. This effect by the binaural sound recording is achieved as a consequence of an audio signal having an acoustic characteristic extremely close to that of a sound arriving at a human eardrum, which audio signal is obtained by recording a sound near both ears, in particular, near an entrance of an external auditory canal.

Until a sound arrives at the human eardrum from a sound source (e.g., a speaker and a musical instrument), the timbre thereof is changed because of reflection and diffraction caused at various objects. Among these objects, the influence of a head, a torso, and an auricle of a listener gives a human a clue for perceiving a direction of arrival. Information representing a transfer characteristic of a sound from a sound source to eardrums of both ears within a free space is called a head-related transfer function (HRTF). Once a database is compiled on the head-related transfer function, a sound can be expressed three-dimensionally by being played back with headphones through signal processing based on the head-related transfer function without putting the binaural microphones on both the ears of a user every time for recording. However, the binaural microphone is required also to measure the head-related transfer function.

Typically, when a researcher or the like measures the head-related transfer function, an impression material is inserted to the inside of the external auditory canal and a microphone is fixed at a position where a sound receiving surface thereof is visible from an external auditory canal entrance. There is a first advantage of a method of this measurement method in that, because the binaural microphone can be created so as to fit into a personal shape of the external auditory canal, the microphone is always fixed at the same position and thus, a position shift of the microphone over time and a position shift of the microphone before and after removing and putting the microphone are unlikely to occur. Particularly, in order to accurately replicate the resonance at a cavum conchae within the auricle, portions of the impression material and the microphone protruding to the cavum conchae from the external auditory canal are required to be kept minimized (for example, refer to Non-patent Document 1). When the cavum conchae is filled with the impression material or the microphone, the resonance generated at the cavum conchae is hindered, causing a possibility of accurate localization, natural localization, and a timbre not being able to be reproduced. When the impression material is used to set up the binaural microphone, by observing these precautions depending on a personal shape of the external auditory canal, a binaural microphone having reproducibility can be obtained.

As another advantage of fixing the microphone at the inside of the external auditory canal by using the impression material to measure the head-related transfer function, a fact that an external sound is blocked from entering the inside of the external auditory canal and accordingly, the resonance at the inside of the external auditory canal is not generated is given. There are large differences in the resonance at the inside of the external auditory canal from person to person and thus, a possibility of an adverse influence occurring in the localization when a person other than a measurement subject hears is increased. Such a sound recording approach is called a "block approach", which is a method generally used in the measurement of the head-related transfer function.

In the above-described method, however, every time a wearer who wears the microphone during recording is changed, it is necessarily required to fill the external auditory canal of the wearer with the impression material. This work causes unnecessary damage to the microphone and also acts as a load for the wearer and a worker, while bringing about a safety problem on the ears of the wearer.

Meanwhile, a canal type earphone device used while being inserted deeper into an earhole than the case of an inner ear type has been widely known. For example, an earphone device has been proposed in which, by arranging a sound conduit diagonally from a position off the center of a housing, the housing is accommodated in the cavum conchae while the sound conduit is arranged up to the external auditory canal entrance (for example, refer to Patent Document 1). In this type of the earphone device, however, the sound conduit only can be inserted until a point just before a first curve of the external auditory canal. In addition, an ear piece is inserted into a root portion of a relatively soft tragus and thus, a sufficient sealing effect cannot be obtained.

SUMMARY OF THE INVENTION

Problems to be Solved by the Invention

An object of the technology to be disclosed in the present description is to provide an excellent in-the-ear device used while being worn on a human ear such as a binaural microphone or an earphone.

Another object of the technology to be disclosed in the present description is to provide an excellent in-the-ear device that can be inserted closer to the inside than a first curve of an external auditory canal of almost every wearer regardless of differences from person to person.

Solutions to Problems

The present application has been made by taking the above problems into consideration and a technology according to claim 1 is an in-the-ear device including:

a main body unit configured to be inserted closer to the inside than a first curve of an external auditory canal and having a back surface that forms a surface substantially same as a surface of a cavum conchae; and an external auditory canal insertion unit provided to protrude toward an inner section of the external auditory canal from a front surface of the main body unit.

In a technology according to claim 2 of the present application, the external auditory canal insertion unit of the in-the-ear device according to claim 1 is disposed at a center of the front surface of the main body unit or a position offset toward a front side from the center of the front surface.

In a technology according to claim 3 of the present application, the external auditory canal insertion unit of the in-the-ear device according to claim 2 is disposed so as to be inclined toward a rear side by a predetermined angle of inclination with respect to a center line of the main body unit.

In a technology according to claim 4 of the present application, the in-the-ear device according to claim 3 further includes an ear piece attached to the external auditory canal insertion unit.

In a technology according to claim 5 of the present application, an end surface of the ear piece of the in-the-ear device according to claim 4 is diagonally cut in accordance with the predetermined angle of inclination so as to be parallel to the front surface of the main body unit.

In a technology according to claim 6 of the present application, the in-the-ear device according to claim 1 includes a microphone unit within the main body unit.

In a technology according to claim 7 of the present application, a sound receiving surface of the microphone unit of the in-the-ear device according to claim 6 is in contact with an external world on a back surface side of the main body unit.

In a technology according to claim 8 of the present application, the in-the-ear device according to claim 7 further includes a shielding unit, at least a portion of which sticks out from the back surface of the main body unit.

In a technology according to claim 9 of the present application, in the in-the-ear device according to claim 8, the shielding unit is flush with the sound receiving unit.

In a technology according to claim 10 of the present application, in the in-the-ear device according to claim 8, a cable that transmits an audio signal obtained through the sound pickup by the microphone unit to the outside is configured so as to be inserted through an outlet hole formed on the shielding unit from an opposite side of the sound receiving surface and then discharged to the outside of the external auditory canal via the inside of the main body unit or a gap between the main body unit and the microphone unit.

In a technology according to claim 11 of the present application, in the in-the-ear device according to claim 10, the outlet hole is disposed lower than a horizontal line passing through a center of the sound receiving surface.

In a technology according to claim 12 of the present application, the in-the-ear device according to claim 1 includes a driver unit within the main body unit. Additionally, the external auditory canal insertion unit includes a sound conduit.

In a technology according to claim 13 of the present application, the in-the-ear device according to claim 12 further includes a stopper, at least a portion of which sticks out from the back surface of the main body unit.

In a technology according to claim 14 of the present application, the in-the-ear device according to claim 1 includes a driver unit in the external auditory canal insertion unit.

In a technology according to claim 15 of the present application, the in-the-ear device according to claim 1 further includes a microphone unit and a driver unit.

In a technology according to claim 16 of the present application, the microphone unit of the in-the-ear device according to claim 15 is disposed within the main body unit and the driver unit is disposed at a tip end of the external auditory canal insertion unit.

In a technology according to claim 17 of the present application, the driver unit and the microphone unit are arranged in this order from an inner side of the external auditory canal within the main body of the in-the-ear device according to claim 15. Additionally, the external auditory canal insertion unit is configured so as to include a sound conduit.

In a technology according to claim 18 of the present application, a sound receiving surface of the microphone unit of the in-the-ear device according to claim 15 is in contact with an external world on a back surface side of the main body unit.

In a technology according to claim 19 of the present application, the in-the-ear device according to claim 15 further includes a shielding unit, at least a portion of which sticks out from the back surface of the main body unit.

In a technology according to claim 20 of the present application, in the in-the-ear device according to claim 15, a cable that transmits an audio signal obtained through the sound pickup by the microphone unit to the outside or transmits an audio signal to be input to the driver unit is inserted by way of an inlet/outlet hole disposed lower than a horizontal line passing through a center of the sound receiving surface.

Effects of the Invention

According to the technology to be disclosed in the present description, it is possible to provide an excellent in-the-ear device that can be used by almost every wearer while being inserted closer to the inside than a first curve of an external auditory canal regardless of differences from person to person.

The in-the-ear device to which the technology to be disclosed in the present description is applied can be commonly used by almost every wearer and worn so as to be inserted closer to the inside than a first curve of the external auditory canal. When this in-the-ear device is used as the binaural microphone, because a portion protruding to the cavum conchae from the external auditory canal can be kept minimized, it is possible to accurately replicate the resonance at the cavum conchae within the auricle, thereby achieving a binaural microphone with reproducibility. Meanwhile, when this in-the-ear device is used as the earphone, because the sound conduit can be inserted closer to the inside than the first curve of the external auditory canal and the acoustics accordingly can be guided closer to an eardrum, it is possible to provide a fine quality of audio while driving with low consumption.

Note that the effects described in the present description merely serve as examples and the effects of the present invention are not construed to be limited thereto. An additional effect other than the aforementioned effects can be further obtained as well in the present invention.

Still another object, feature, and advantage of the technology to be disclosed in the present description will be made clear through more detailed description based on the embodiments mentioned below and the accompanying drawings.

MODE FOR CARRYING OUT THE INVENTION

Hereinafter, embodiments of the technology to be disclosed in the present description will be described in detail with reference to the drawings.

Figure 1:
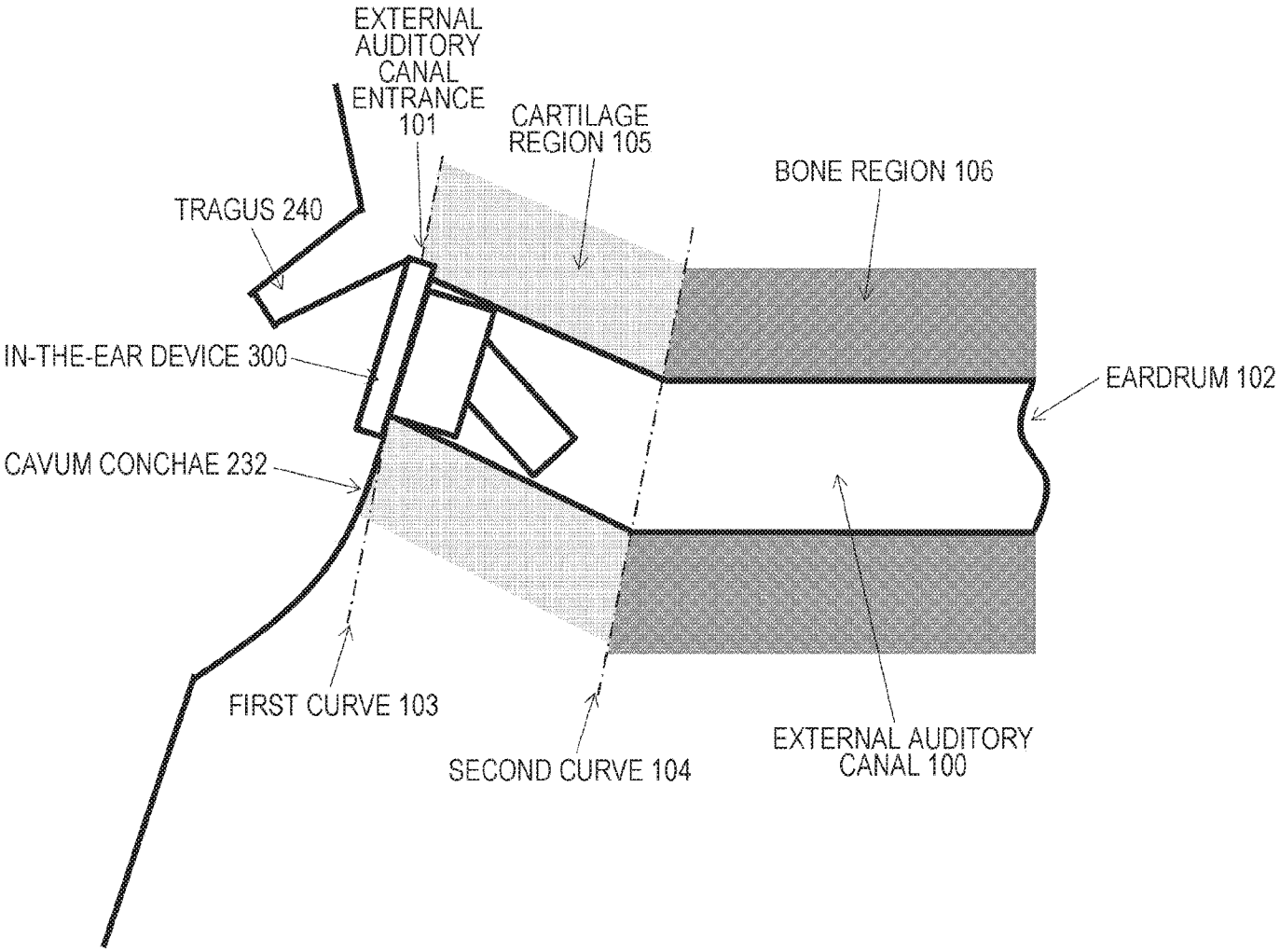
FIG. 1 is a view illustrating a shape of an external auditory canal of a left ear by using a horizontal cross-sectional view of a human head.
Figure 2:
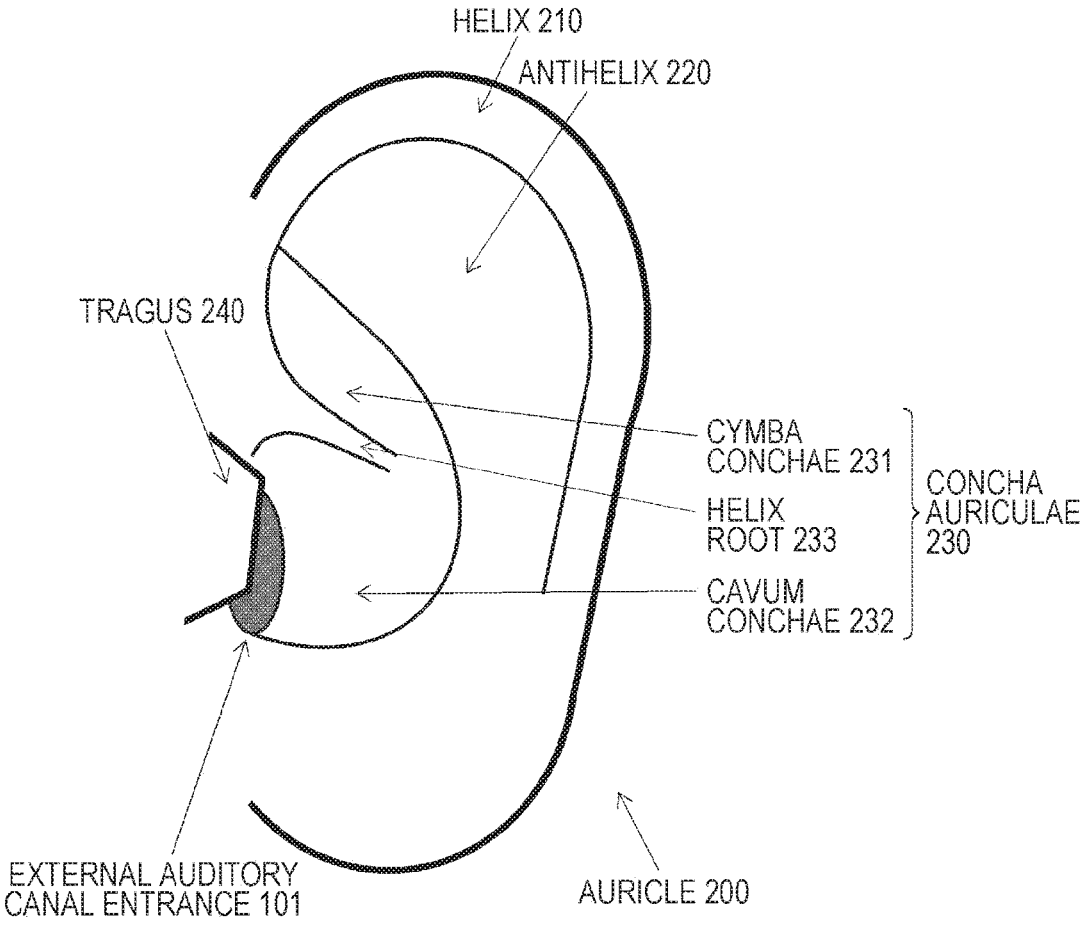
FIG. 2 is a view illustrating a shape of an external appearance of a left ear of a human.

FIG. 1 illustrates a shape of an external auditory canal 100 of a left ear by using a horizontal cross-sectional view of a human head. Meanwhile, FIG. 2 illustrates a shape of an external appearance of a left ear (auricle 200) of a human. In addition, FIG. 1 also illustrates a state where an in-the-ear device 300 illustrated in FIG. 3 (described later) is inserted into the external auditory canal 100.

The external auditory canal 100 is a hole starting from an external auditory canal entrance 101 and terminating at an inner side of an eardrum 102 and generally has a length of approximately 25 to 30 millimeters. The auricle 200 is located at an outer side of the external auditory canal 100 and has a complicated uneven shape formed by a shape of an auricular cartilage. The auricle 200 has functions of picking up a sound and identifying a direction of a sound source. Additionally, the external auditory canal 100 has a tube structure in which one end thereof is opened and another end thereof is closed and therefore, a sound picked up at the auricle 200 is even increased because of the resonance within the external auditory canal 100.

Generally describing a structure of the auricle 200, as illustrated in FIG. 2, a helix 210, an antihelix 220, a concha auriculae 230, and a tragus 240 are located in this order from the outer side of the auricle 200. The concha auriculae 230 forms a most depressed portion at the center of the ear and is divided into a cymba conchae 231 located at an upper half and a cavum conchae 232 located at a lower half with a helix root 233 interposed therebetween as a boundary. In addition, the external auditory canal entrance 101 is located near the tragus 240 of the cavum conchae 231.

Referring to the horizontal cross-section of the head illustrated in FIG. 1, the external auditory canal 100 of a human meanders substantially in an S-shape as a common feature in such a manner that a foreign object is prevented from accidentally getting therein. A bend closer to the external auditory canal entrance 101 (that is, farther from the eardrum) is called a first curve 103. A wall surface closer to the entrance 101 of the external auditory canal 100 (that is, farther from the eardrum) forms a cartilage region 105 constituted by a relatively flexible wall surface because of a cartilage tissue residing therein. A cartilage of the external auditory canal 100 continues from a cartilage of the auricle 200. The cartilage region is deformed and moved in response to the action of a lower jaw during a conversation, a yawn, mastication while eating, and so on.

Meanwhile, when advancing to an inner section of the external auditory canal 100 up to near a middle part, the wall surface is shifted to a bone region proximal to the eardrum. The bone region 106 is rigid because of a bone tissue residing therein. A skin in the bone region 106 is thinner than that of the cartilage region and at the same time, sensitive to contact or pressure. The external auditory canal 100 bends to a larger extent near a boundary between the cartilage region 105 and the bone region 106, which is called a second curve 104 of the external auditory canal 100. The size of the second curve 104 significantly varies from person to person.

Figure 3:
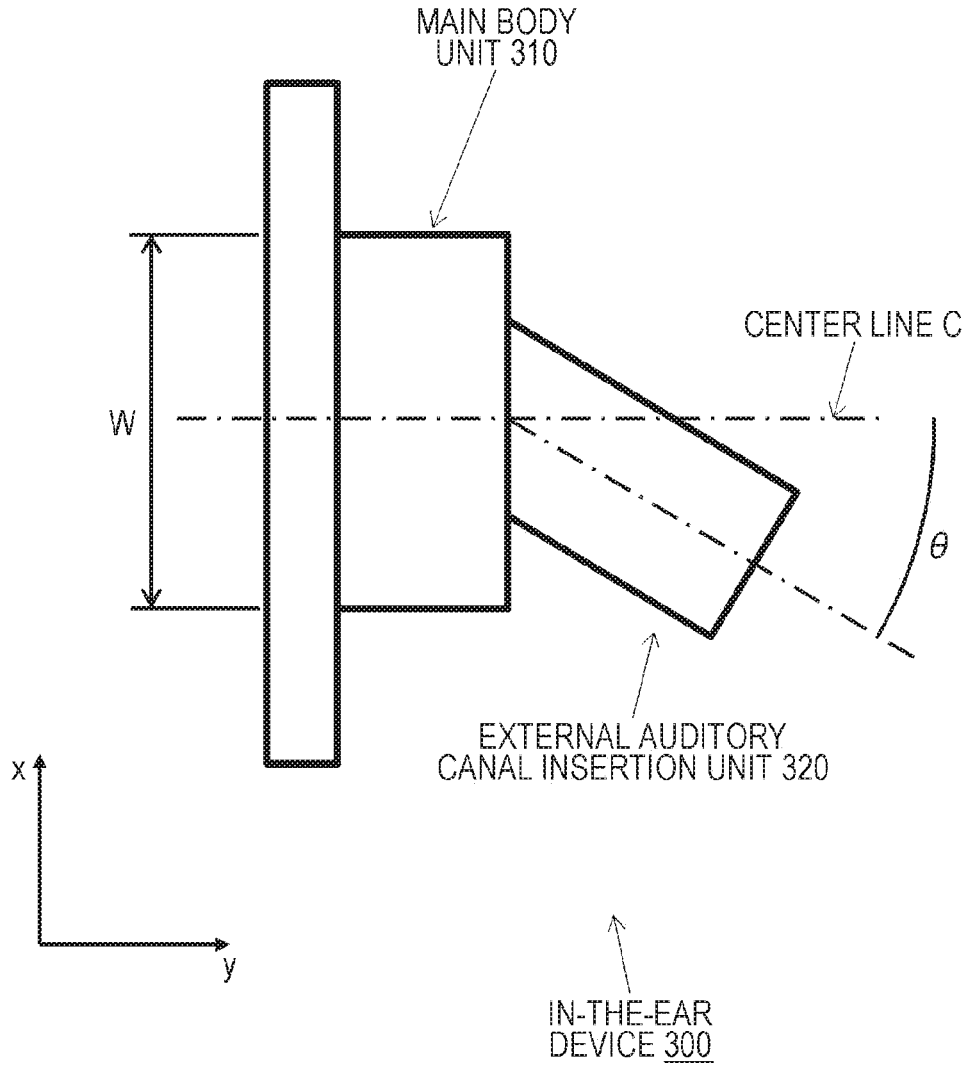
FIG. 3 is a view schematically illustrating a configuration of an in-the-ear device 300 to which the technology to be disclosed in the present description is applied.

FIG. 3 schematically illustrates a configuration of the in-the-ear device 300 to which the technology disclosed in the present description is applied. Note that, by defining a front-rear direction as an X axis, a left-right direction as a Y axis, and an up-down direction (not illustrated) as a Z axis when the in-the-ear device 300 is worn on the left ear of a human, FIG. 3 illustrates a top view when viewed from an X-Y plane.

The in-the-ear device 300 is used while being inserted into a human ear (external auditory canal 100), examples of which include the microphone and the earphone. This in-the-ear device 300 includes a main body unit 310 substantially round column-shaped and a cylindrical external auditory canal insertion unit 320 provided to protrude diagonally from a front surface of the main body unit 310 (that is, an end surface closer to the eardrum 102). As illustrated in FIG. 1, the main body unit 310 is inserted closer to the inside than the first curve 103 of the external auditory canal 100. Accordingly, a width W of the main body unit 310 is limited to equal to or smaller than a typical inner diameter of the external auditory canal 100. As will be described later, while the in-the-ear device 300 is worn on the ear, a back surface of the main body unit 310 (an end surface facing an outer side of the external auditory canal 100) forms a surface substantially same as that of the cavum conchae 232.

Generally, it is favorable that the in-the-ear device used to input or output audio such as the microphone or the earphone be inserted as deeper into the external auditory canal 100 as possible because a better acoustic characteristic can be provided. In order to stably fix the in-the-ear device 300 in an earhole, it is desirable to insert the in-the-ear device 300 deeper into the external auditory canal 100 to fix. However, due to the influence of the steep first curve, the in-the-ear device abuts on a bending point before being inserted deeper.

When the in-the-ear device 300 serves as the binaural microphone, in order to accurately replicate the resonance at the cavum conchae 232 within the auricle, it is preferable that a back surface of a main body of the in-the-ear device 300 (a sound receiving surface in the case of the microphone) be made flush with the cavum conchae 232 such that a portion protruding to the cavum conchae from the external auditory canal is kept minimized. Along with this, the external auditory canal insertion unit 320 provided to protrude diagonally from the front surface of the main body unit 310 is required to correspond to the first curve 103.

In the example illustrated in FIG. 3, the external auditory canal insertion unit 320 is provided to protrude diagonally from the front surface of the main body unit 310 toward the inner section more closely than the first curve 103. The external auditory canal insertion unit 320 has an elongated external form substantially in a round column shape. The external auditory canal insertion unit 320 is disposed so as to be inclined toward a rear side (in a minus X direction) by a predetermined angle of inclination θ with respect to a center line C of the main body unit 310 within an X-Y surface and a tip end thereof faces a direction for separating from the center line C.

Figure 4:
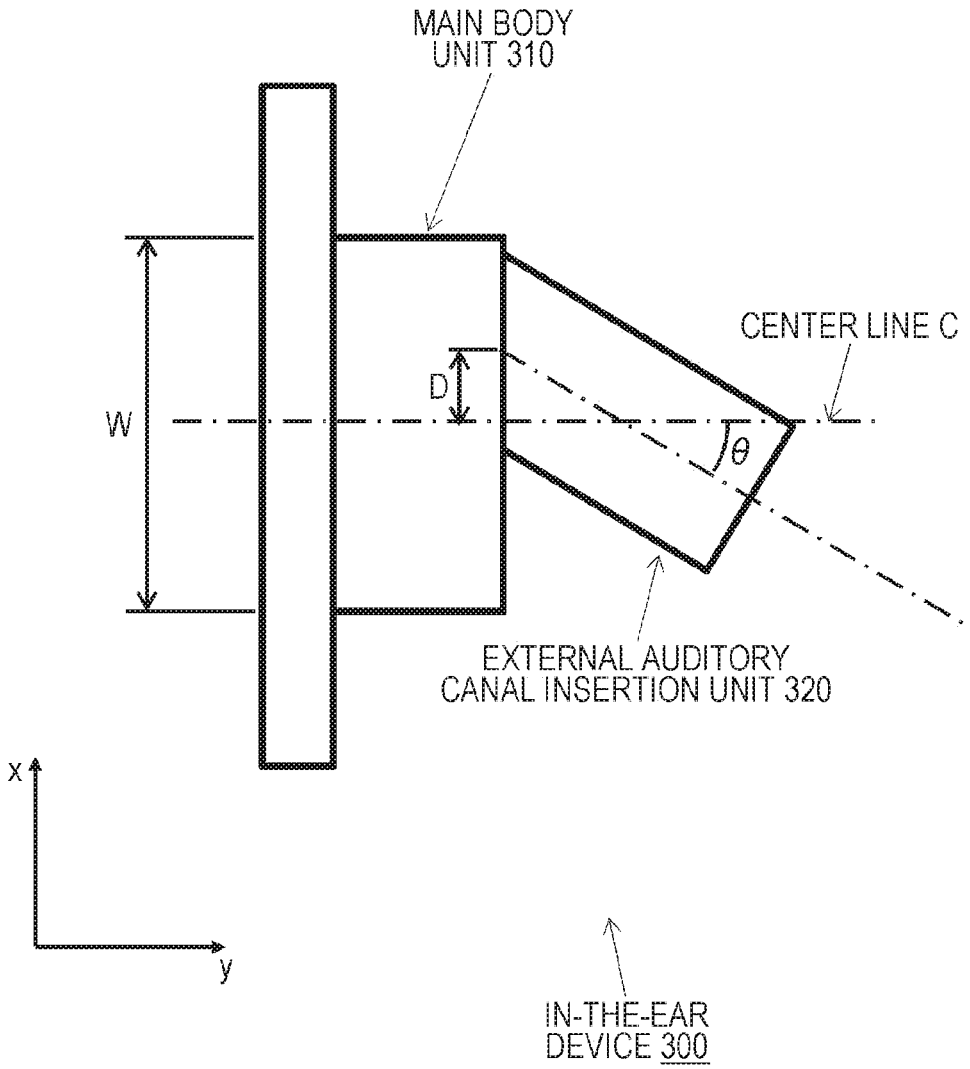
FIG. 4 is a view illustrating a variation of the in-the-ear device 300 (an example in which an offset is given to a position of an external auditory canal insertion unit 320).

In the example illustrated in FIG. 3, the external auditory canal insertion unit 320 is disposed at a center of the front surface of the main body unit 310. Alternatively, as illustrated in FIG. 4, the external auditory canal insertion unit 320 may be disposed at a position offset by a predetermined offset amount D from the center of the front surface of the main body unit 310 toward a front side (in an x direction), that is, in an opposite direction to a direction in which the external auditory canal insertion unit 320 is inclined. With this, as illustrated in FIG. 1, the back surface of the main body unit 310 of the in-the-ear device 300 (the sound receiving surface in the case of the microphone) does not stick out from the cavum conchae 232. Consequently, when the in-the-ear device 300 is used as the binaural microphone, it is made possible to carry out recording while the effect of the resonance at the cavum conchae 232 is not hindered by the sound receiving surface of the main body unit 310.

Additionally, in order to correspond to the first curve 103, the external auditory canal insertion unit 320 is provided so as to protrude toward the inner section and inclined toward the rear side (in the minus X direction) by the predetermined angle of inclination θ with respect to the center line C of the main body unit 310. Accordingly, the external auditory canal insertion unit 320 goes through the entire first curve 103 and a tip end portion thereof reaches near a point just before the second curve 104. When the in-the-ear device 300 is used as the earphone and the external auditory canal insertion unit 320 is used as the sound conduit, a sound can be guided until a point just before the second curve 104 (that is, a point closer to the eardrum 102) and thus, high quality audio can be delivered with lower driving electric power.

Figure 5:
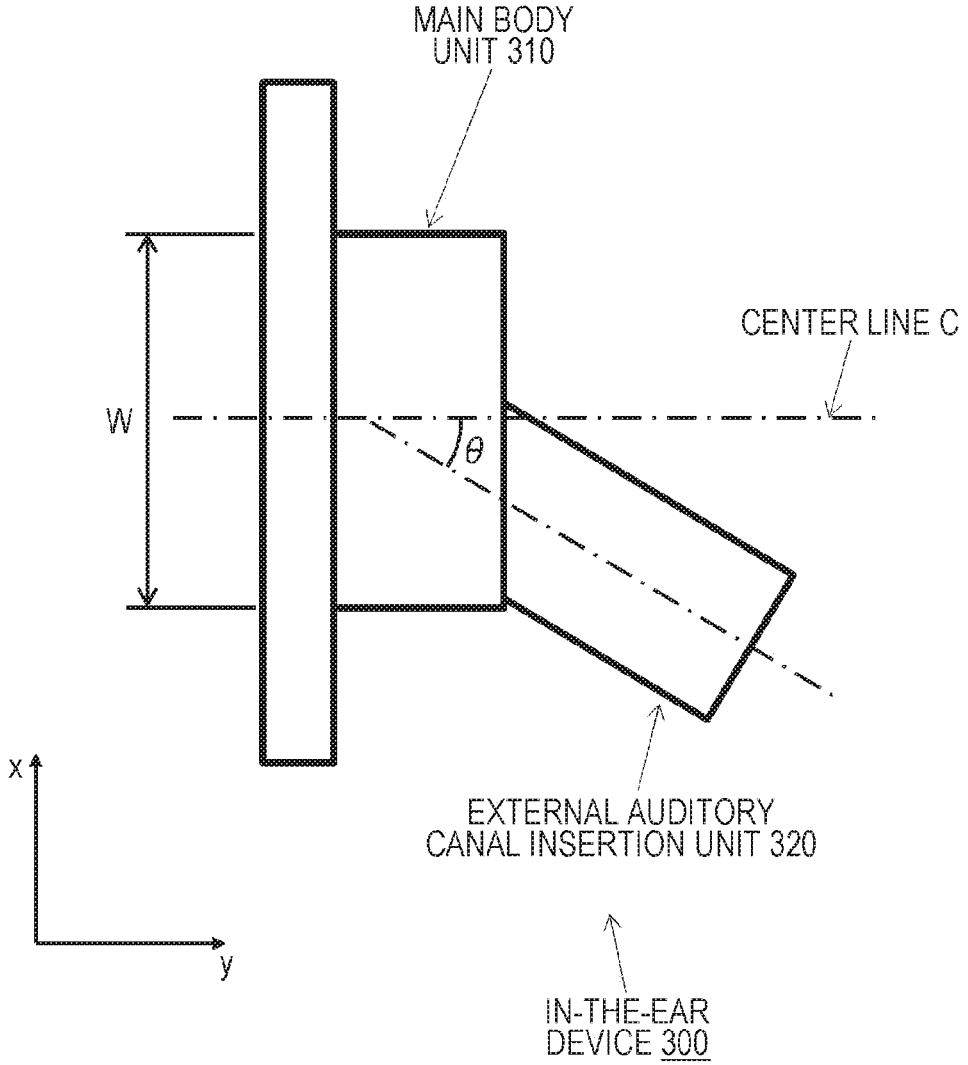
FIG. 5 is a view illustrating a variation of the in-the-ear device 300 (an example in which another offset is used for the position of the external auditory canal insertion unit 320).

Meanwhile, as illustrated in FIG. 5, when the external auditory canal insertion unit 320 is disposed at a position offset from the center of the front surface of the main body unit 310 by the same angle of inclination θ toward the rear side (in the minus x direction), that is, in a direction in which the external auditory canal insertion unit 320 is inclined, the tip end of the external auditory canal insertion unit 320 abuts on a wall surface of the first curve 103 on the inner side (or the main body unit 310 that has projected due to the offset abuts on the wall surface of the first curve 103 on the outer side), which acts as an unfavorable factor in going through the entire first curve 103 and thus is not preferable.

Figure 6:
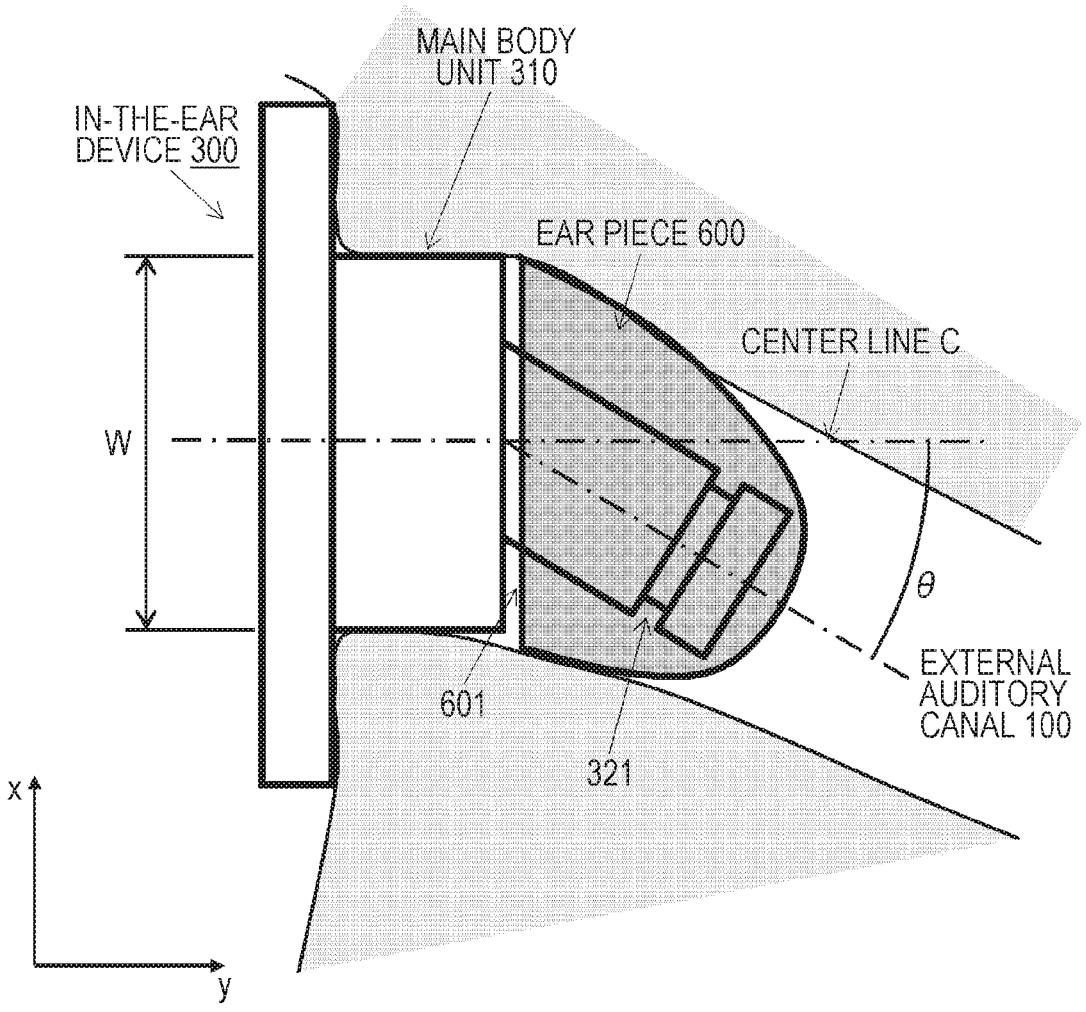
FIG. 6 is a view illustrating a state where an ear piece 600 whose end surface is diagonally cut is attached to the external auditory canal insertion unit 320 of the in-the-ear device 300.

FIG. 6 illustrates a state where an ear piece 600 is attached to the external auditory canal insertion unit 320 of the in-the-ear device 300 illustrated in FIG. 3. The ear piece 600 is changed to a shape consistent with the external auditory canal 100 when the in-the-ear device 300 is worn on the human ear. The ear piece 600 is made of an elastic material such as silicone rubber, urethane-based resin, or acrylic-based resin and configured such that the shape thereof can be freely deformed. As a result, the ear piece 600 makes close contact with an inner wall of the external auditory canal 100 when inserted into the external auditory canal 100 and can maintain the wearing state of being in close contact with the ear of a user, while providing soft wearing feeling. The external auditory canal insertion unit 320 is inserted into the external auditory canal 100 with this ear piece 600 interposed therebetween and a tip end part thereof reaches a point just before the second curve 104. As additional remarks, the external auditory canal 100 can be closed off by the ear piece 600 at the cartilage region 105 of the external auditory canal 100, which is relatively firm compared to the tragus 240, and thus, more stable waring in which the external auditory canal 100 is sealed than the case of a canal type earphone (for example, refer to Patent Document 1) is achieved. In addition, when the ear piece 600 is attached, an attachment groove 321 for fixing the ear piece 600 is provided so as to be formed on an outer circumference of the external auditory canal insertion unit 320.

Figure 7:
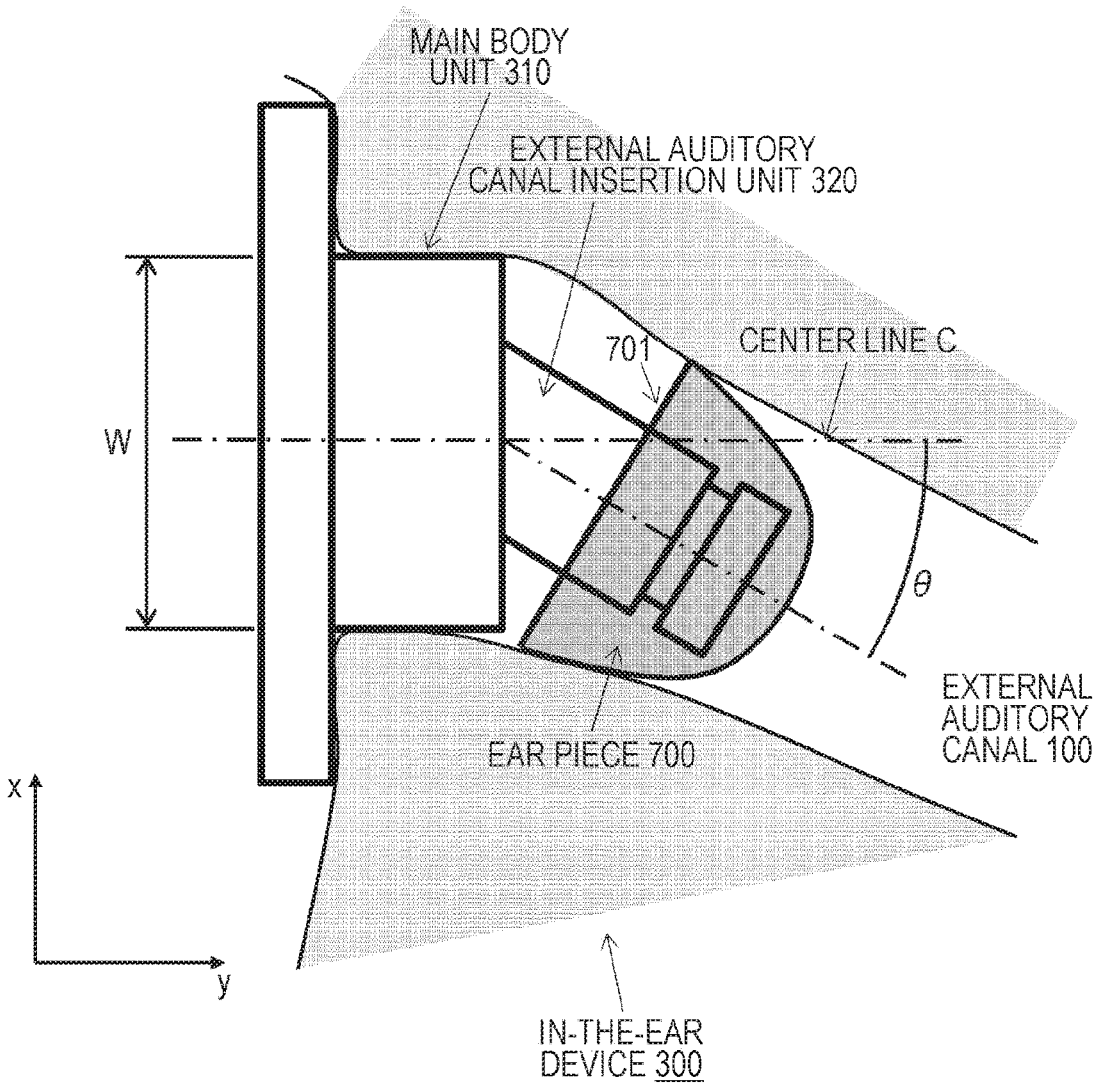
FIG. 7 is a view illustrating a state where an ear piece 700 whose end surface is cut in a straight shape is attached to the external auditory canal insertion unit 320 of the in-the-ear device 300.
Figure 25:
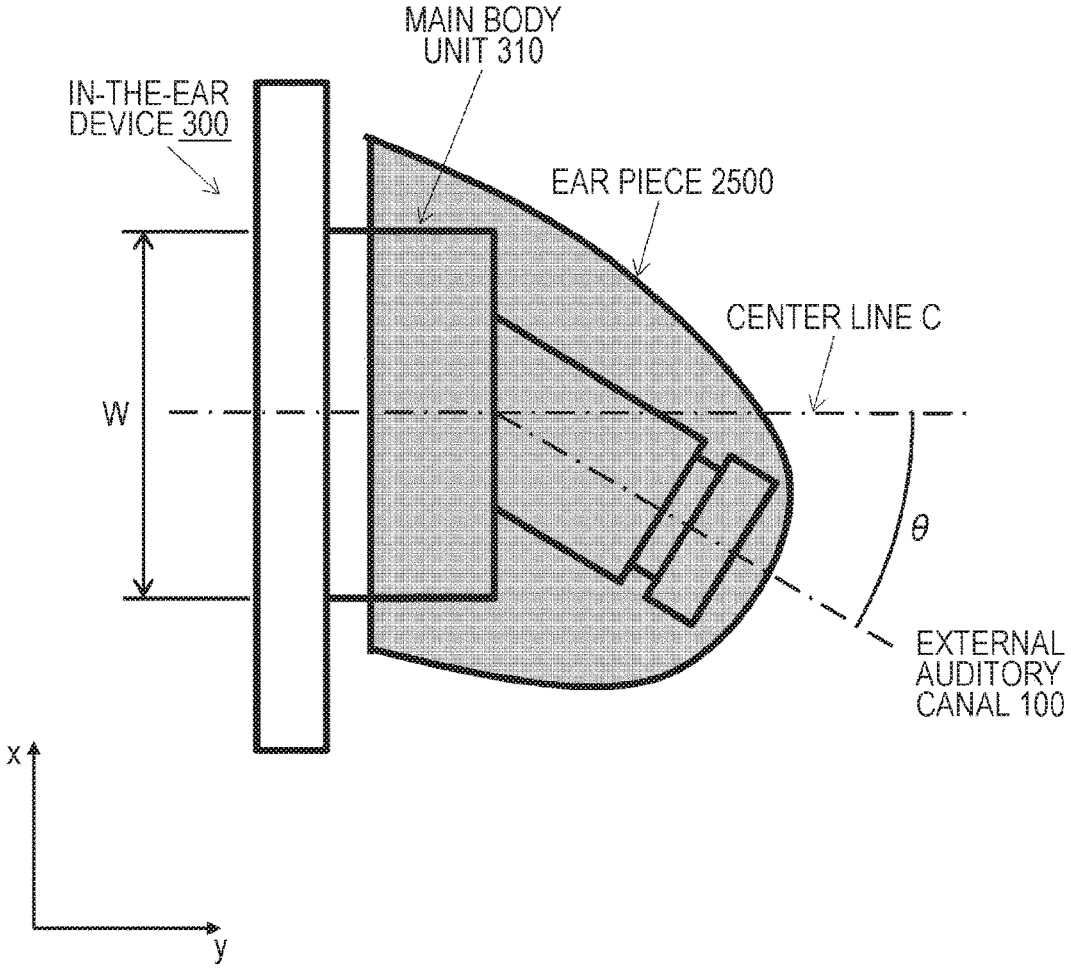
FIG. 25 is a view illustrating a variation of FIG. 6 (a variation of the ear piece).

The external auditory canal insertion unit 320 is disposed so as to be inclined toward the rear side (in the minus X direction) by the predetermined angle of inclination θ with respect to the center line C of the main body unit 310 within the X-Y surface (described earlier). Accordingly, an end surface 601 of the ear piece 600 is diagonally cut in accordance with this angle of inclination θ so as to be parallel to the front surface of the main body unit 310. With this, a contact area between the wall surface of the external auditory canal 100 and the ear piece 600 is made larger and thus, more stable waring in which the external auditory canal 100 is sealed than the case of an ear piece 700 whose end surface 701 is cut in a straight shape as illustrated in FIG. 7 is achieved. As additional remarks, as illustrated in FIG. 25, when an ear piece 2500 whose end surface is extended so as to cover the main body unit 310 and also be parallel to the front surface of the main body unit 310 is used, an effect similar to or superior to that of the example illustrated in FIG. 6 is obtained.

First Working Example

Figure 8:
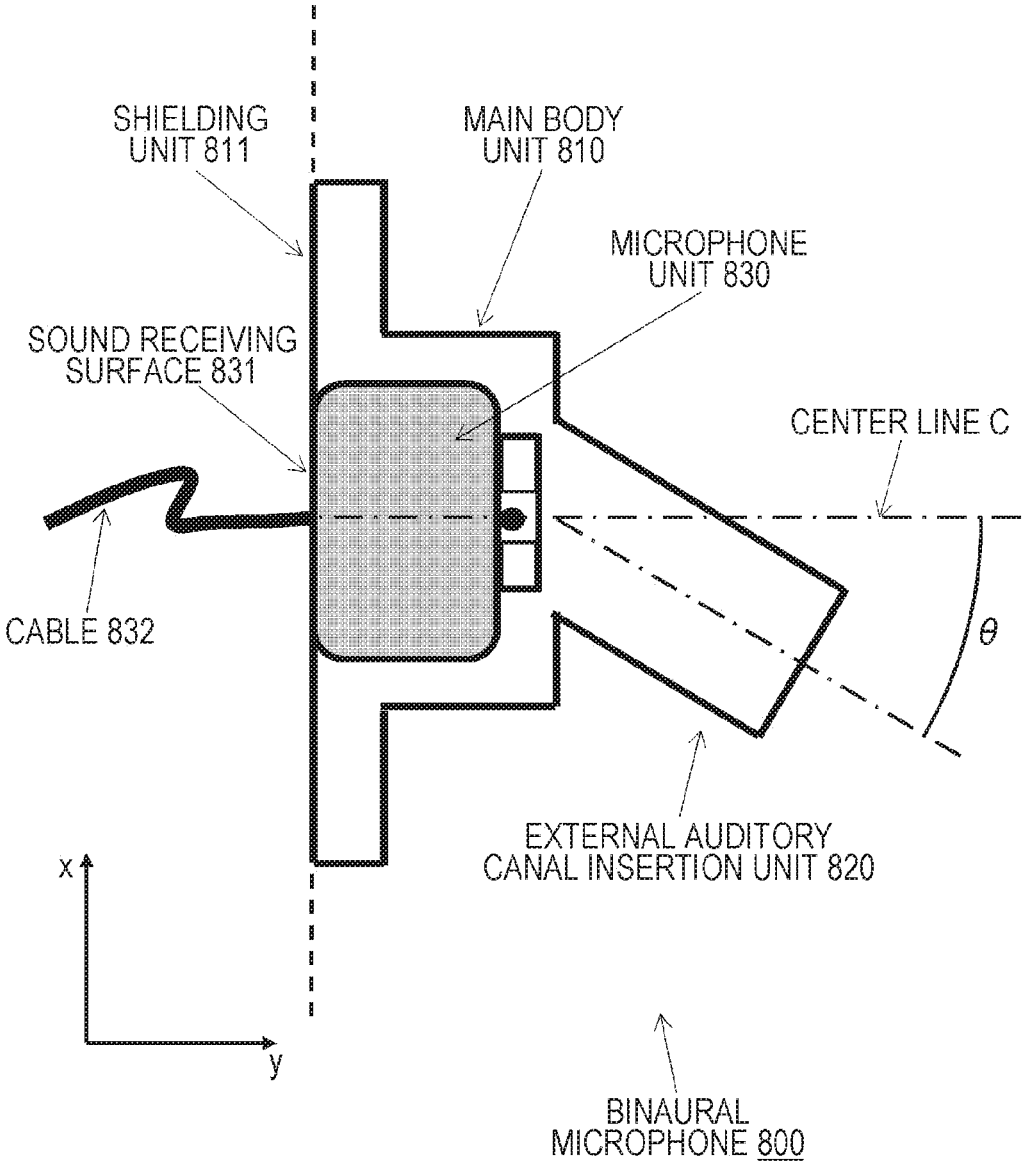
FIG. 8 is a cross-sectional view when a binaural microphone 800 to which the technology to be disclosed in the present description is applied is viewed from an X-Y plane.
Figure 9:
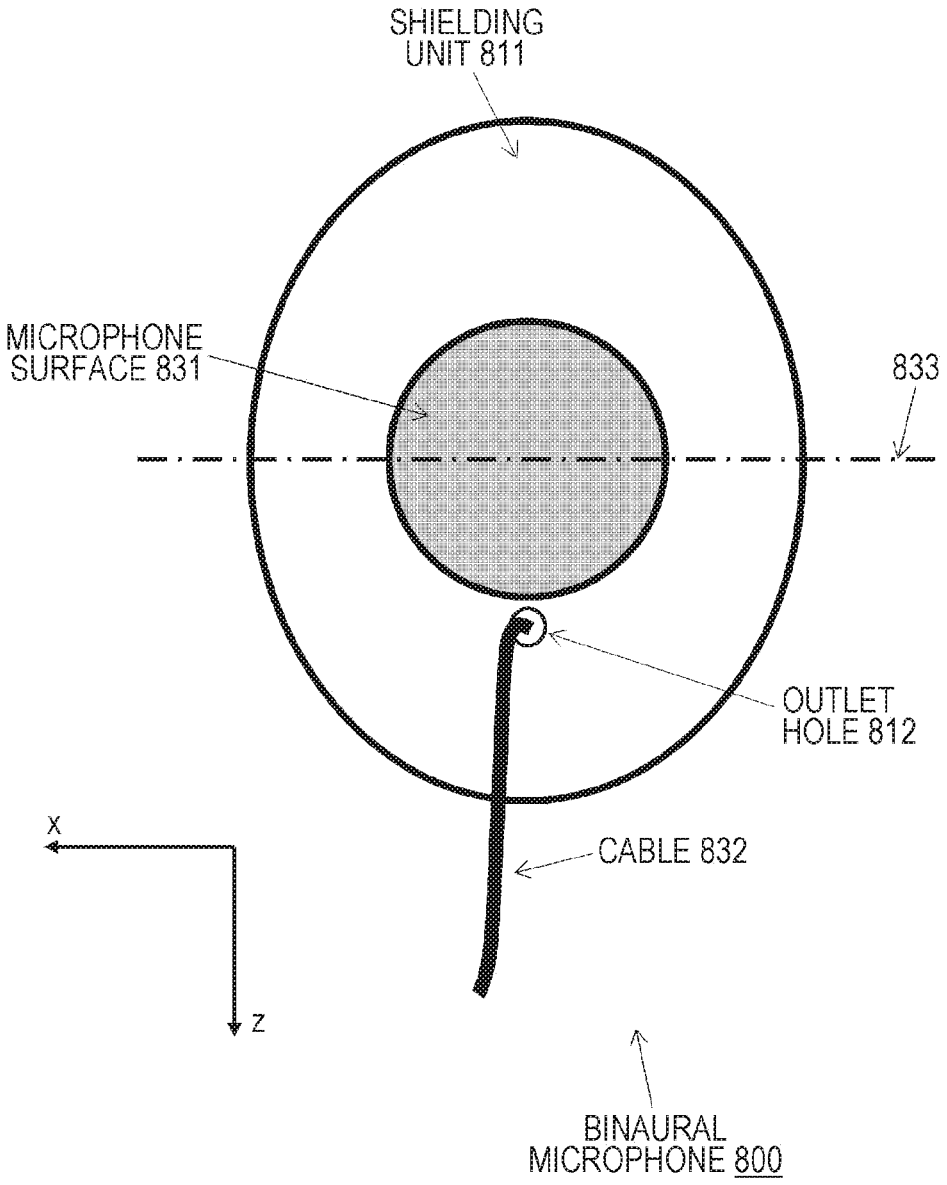
FIG. 9 is a back view when the binaural microphone 800 is viewed from an X-Z plane.
Figure 10:
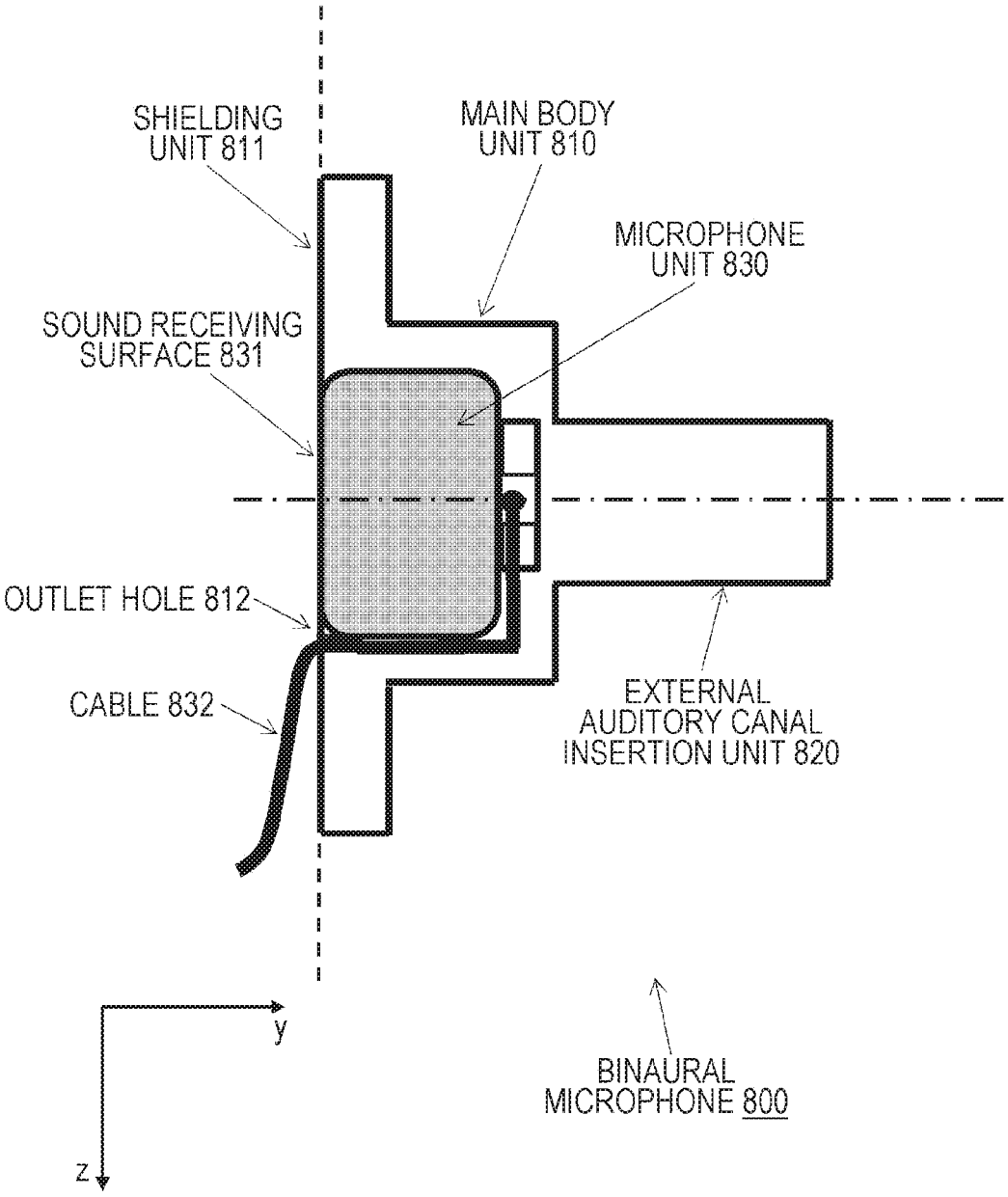
FIG. 10 is a cross-sectional view when the binaural microphone 800 is viewed from a Y-Z plane.

FIG. 8 to FIG. 10 schematically illustrate a configuration of a binaural microphone 800 to which the technology disclosed in the present description is applied. Note that, by defining the front-rear direction as the X axis, the left-right direction as the Y axis, and the up-down direction (not illustrated) as the Z axis when the binaural microphone 800 is worn on the left ear of a human, FIG. 8 illustrates a cross-sectional view when the binaural microphone 800 is viewed from the X-Y plane. Meanwhile, FIG. 9 illustrates a back view when the binaural microphone 800 is viewed from an X-Z plane. In addition, FIG. 10 illustrates a cross-sectional view when the binaural microphone 800 is viewed from a Y-Z plane.

The binaural microphone 800 is used while being inserted into a human ear (external auditory canal 100) and includes a main body unit 810 substantially round column-shaped and a cylindrical external auditory canal insertion unit 820 provided to protrude diagonally from a front surface of the main body unit 810 (that is, an end surface closer to the eardrum 102). As in the in-the-ear device 300 illustrated in FIG. 1, the main body unit 810 is inserted closer to the inside than the first curve 103 of the external auditory canal 100. Additionally, the external auditory canal insertion unit 820 is disposed so as to be inclined at the center of the front surface of the main body unit 810 toward a rear side (in a minus X direction) by a predetermined angle of inclination θ with respect to a center line C of the main body unit 810 and a tip end thereof faces a direction for separating from the center line C. Furthermore, as in FIG. 6, the binaural microphone 800 includes an ear piece, while the external auditory canal insertion unit 820 is inserted into the external auditory canal 100 with the ear piece interposed therebetween and also provided with an attachment groove formed thereon to fix the ear piece. Note that, for convenience, the illustration of the ear piece and the attachment groove is omitted in FIG. 8 and FIG. 10.

A microphone unit 830 is built in the main body unit 810. When the binaural microphone 800 is worn on the human ear, a sound receiving surface 831 configured to pick up a sound is required to face the outside. For this reason, in the working example, the sound receiving surface 831 is in contact with an external world on a back surface side of the main body unit 810, namely, a side opposing the external auditory canal insertion unit 820 as illustrated in FIG. 8 to FIG. 10.

In addition, a shielding unit 811 is set so as to stick out even slightly from the back surface of the main body unit 810 in an XZ direction. This shielding unit 811 is required to be flush with the sound receiving surface 831. With this, an effect of shielding the external auditory canal 100 from a sound entering from the external world can be enhanced. Compared to this, when sufficient shielding from the sound is not provided by the shielding unit 811, the sound entering from the external world resonates in the external auditory canal 100 and additionally reflected therein to disturb the sound input to the sound receiving surface 831. Consequently, an accurate head-related transfer function can no longer be measured. The shielding unit 811 has a size larger than that of the external auditory canal entrance 101 to also play a role as a stopper for blocking the compact binaural microphone 800 from being pushed into the inner section of the external auditory canal 100 deeper than necessary.

A cable 832 that transmits an audio signal obtained through the sound pickup by the microphone unit 830 to the outside is configured as a shield cable. As illustrated in FIG. 10, the cable 832 is inserted through an outlet hole 812 formed on the shielding unit 811 from an opposite side of the sound receiving surface 831 and then discharged to the outside of the external auditory canal 100 via the inside of the main body unit 810 or a gap between the main body unit 810 and the microphone unit 830. It is to be additionally noted that, because the back surface of the microphone unit 830 is configured as the sound receiving surface 831, it is preferable that a terminal for connecting the cable 832 be disposed on the front surface (that is, an end surface closer to the eardrum 102) of the microphone unit 830 rather than the back surface thereof. As illustrated in FIG. 9, it is preferable that the outlet hole 812 be disposed lower than a horizontal line 833 passing through a center of the sound receiving surface 831. With this, it is possible to prevent an adverse influence that disturbs a sound input to the sound receiving surface 831 due to the influence of the cable 832 as in a case where the cable 832 hanging down touches the sound receiving surface 831.

Figure 11:
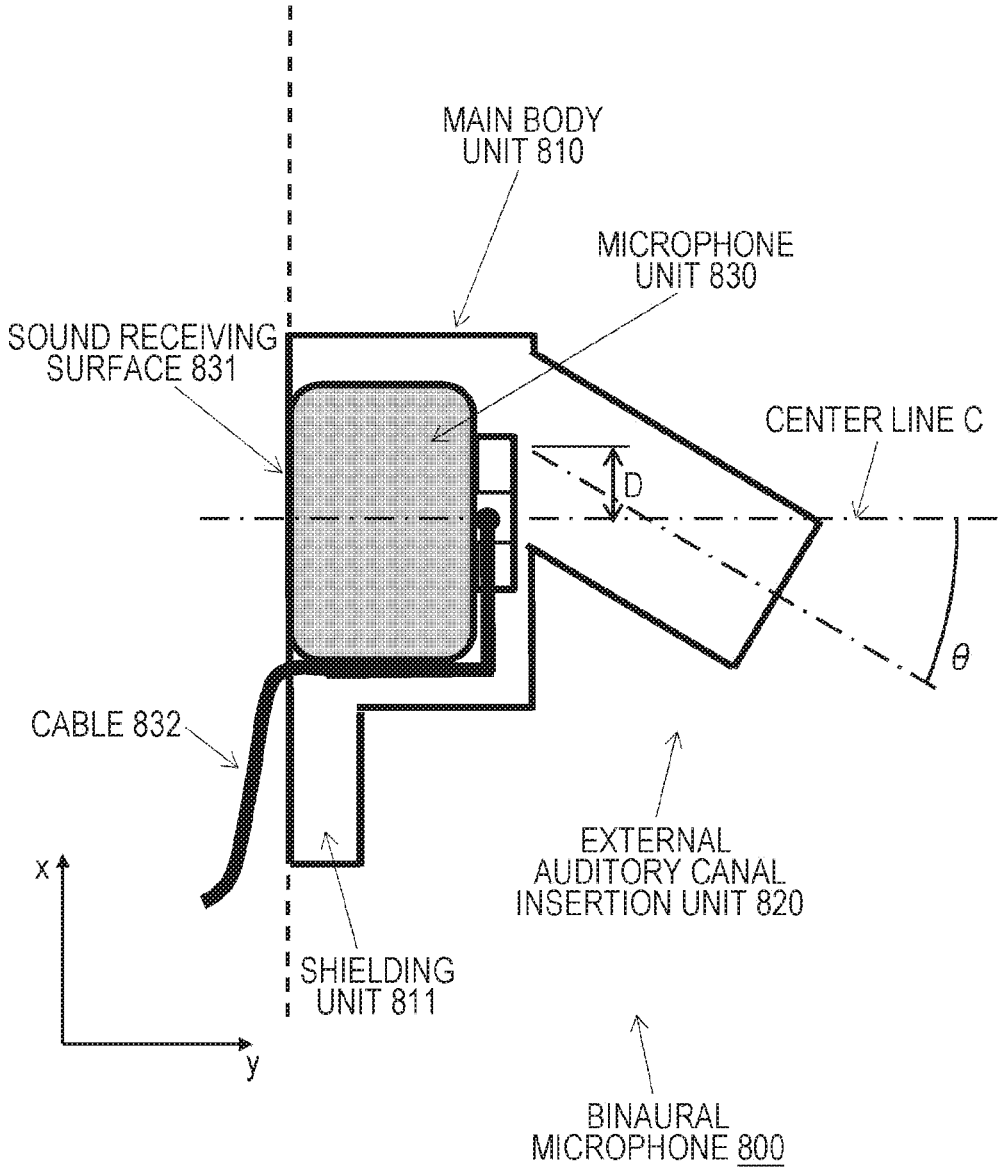
FIG. 11 is a cross-sectional view when the binaural microphone 800 (variation) is viewed from the X-Y plane.
Figure 12:
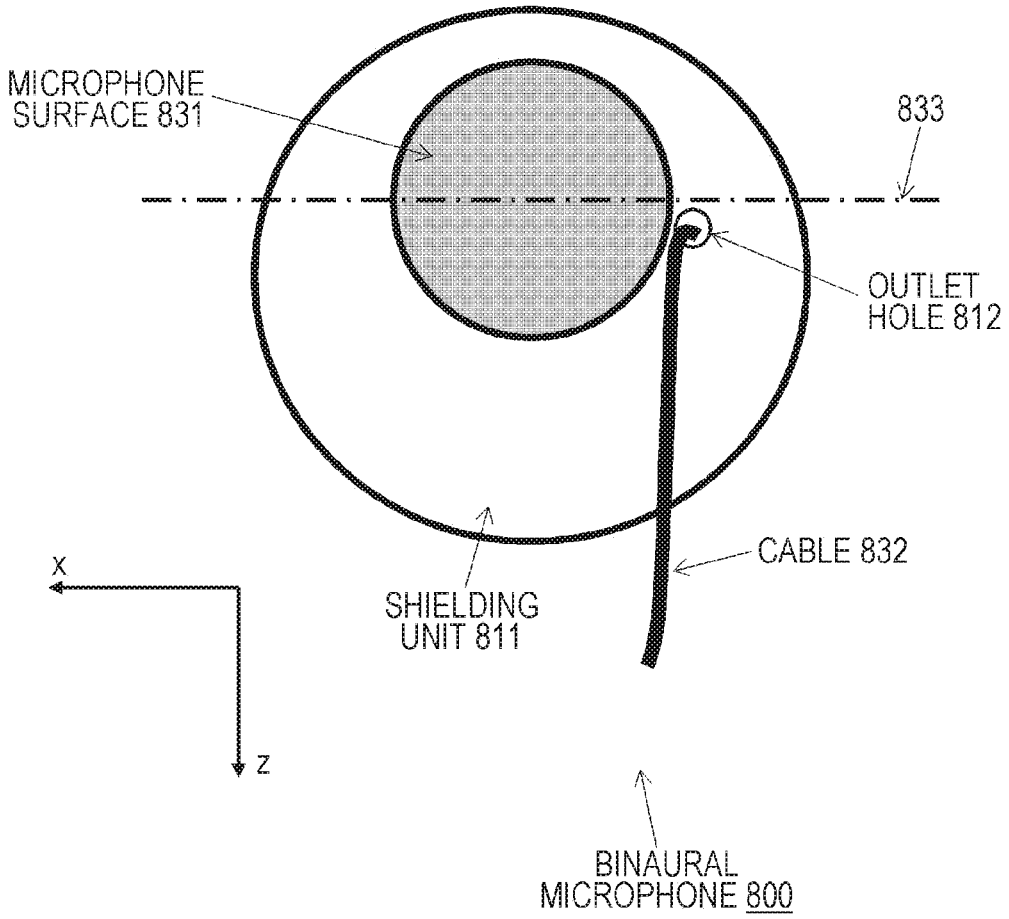
FIG. 12 is a back view when the binaural microphone 800 (variation) is viewed from the X-Z plane.
Figure 13:
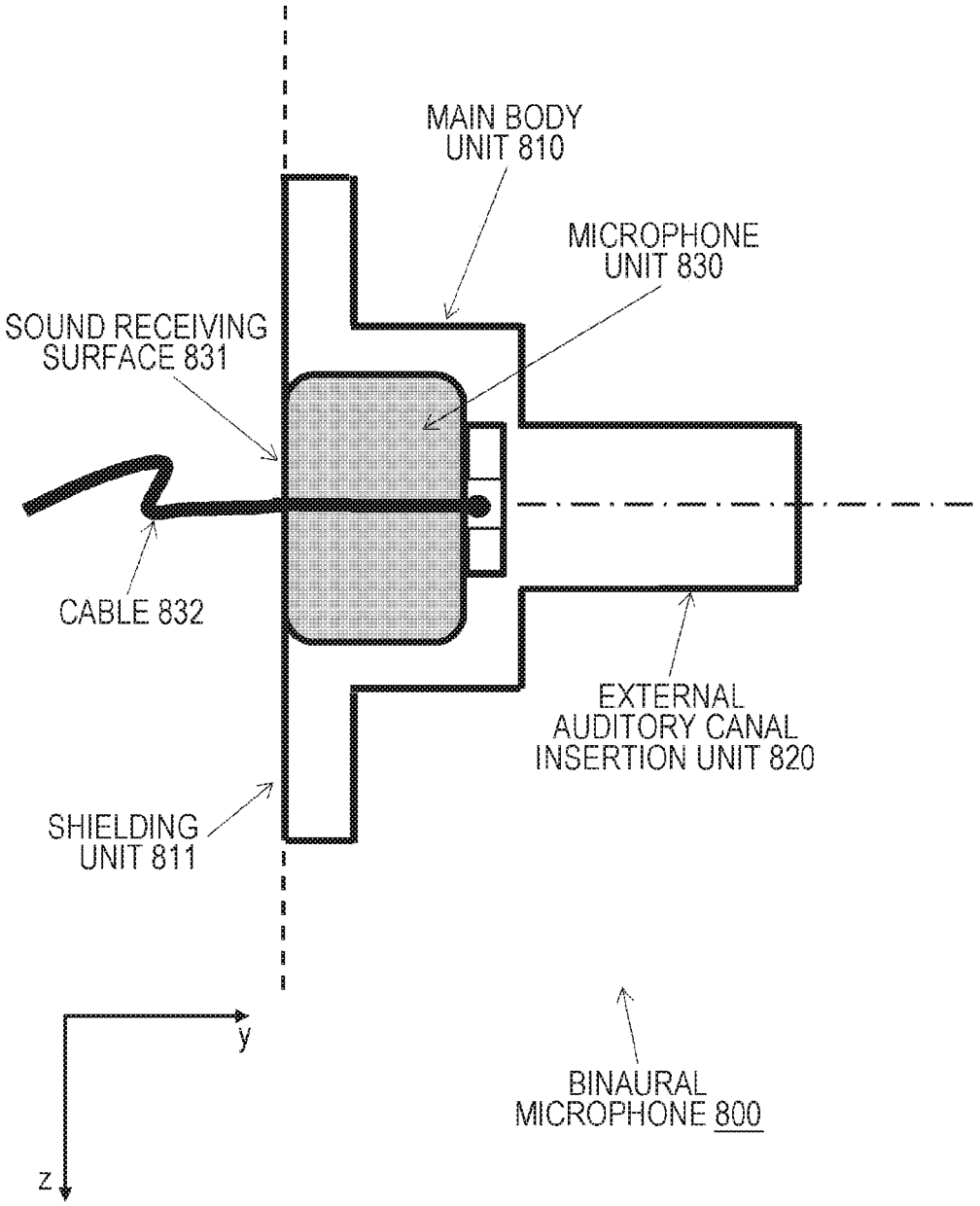
FIG. 13 is a cross-sectional view when the binaural microphone 800 (variation) is viewed from the Y-Z plane.

FIG. 11 to FIG. 13 illustrate a variation of the binaural microphone 800. Specifically, FIG. 11 illustrates a cross-sectional view when the binaural microphone 800 is viewed from the X-Y plane, FIG. 12 illustrates a back view when the binaural microphone 800 is viewed from the X-Z plane, and FIG. 13 illustrates a cross-sectional view when the binaural microphone 800 is viewed from the Y-Z plane. The illustration of the ear piece is omitted for convenience.

In the binaural microphone 800 according to this variation, as it is clear from FIG. 11, the external auditory canal insertion unit 820 is disposed at a position offset by a predetermined offset amount D from the center of the front surface of the main body unit 810 toward a front side (in an x direction), that is, in an opposite direction to a direction in which the external auditory canal insertion unit 820 is inclined. Meanwhile, as it is clear from FIG. 11 and FIG. 12, the shielding unit 811 is only set in a substantially lower half of the sound receiving surface 831. In addition, as it is clear from FIG. 11 to FIG. 13, the outlet hole 812 for discharging the cable 832 is disposed near the horizontal line 833 passing through the center of the sound receiving surface 831.

The points of the binaural microphone 800 according to the working example are as indicated below.

(1) The main body unit 810, the microphone unit 830 built in the main body unit 810, the external auditory canal insertion unit 820, and the shielding unit 811 disposed on the back surface of the main body unit 810 are provided.

(2) The shielding unit 811 is flush with the sound receiving surface 831 and at least has a partial portion sticking out from the back surface of the main body unit 810.

(3) The external auditory canal insertion unit 820 is not orthogonal to the front surface of the main body unit 810 and provided to protrude at a predetermined angle of inclination.

(4) The external auditory canal insertion unit 820 is disposed at the center of the front surface of the main body unit 810 or at a position offset in an opposite direction to a direction in which the external auditory canal insertion unit 820 is inclined.

(5) As for the cable 832, the cable 832 is inserted through the outlet hole 812 formed lower than the horizontal line 833 passing through the center of the sound receiving surface 831 from an opposite side of the sound receiving surface 831 and then discharged to the outside of the external auditory canal 100 after passing through the inside of the main body unit 810 or a gap between the main body unit and the microphone unit 830.

(6) The end surface of the ear piece attached to the external auditory canal insertion unit 820 is diagonally cut so as to be parallel to the front surface of the main body unit 810 (refer to FIG. 6).

Second Working Example

Figure 14:
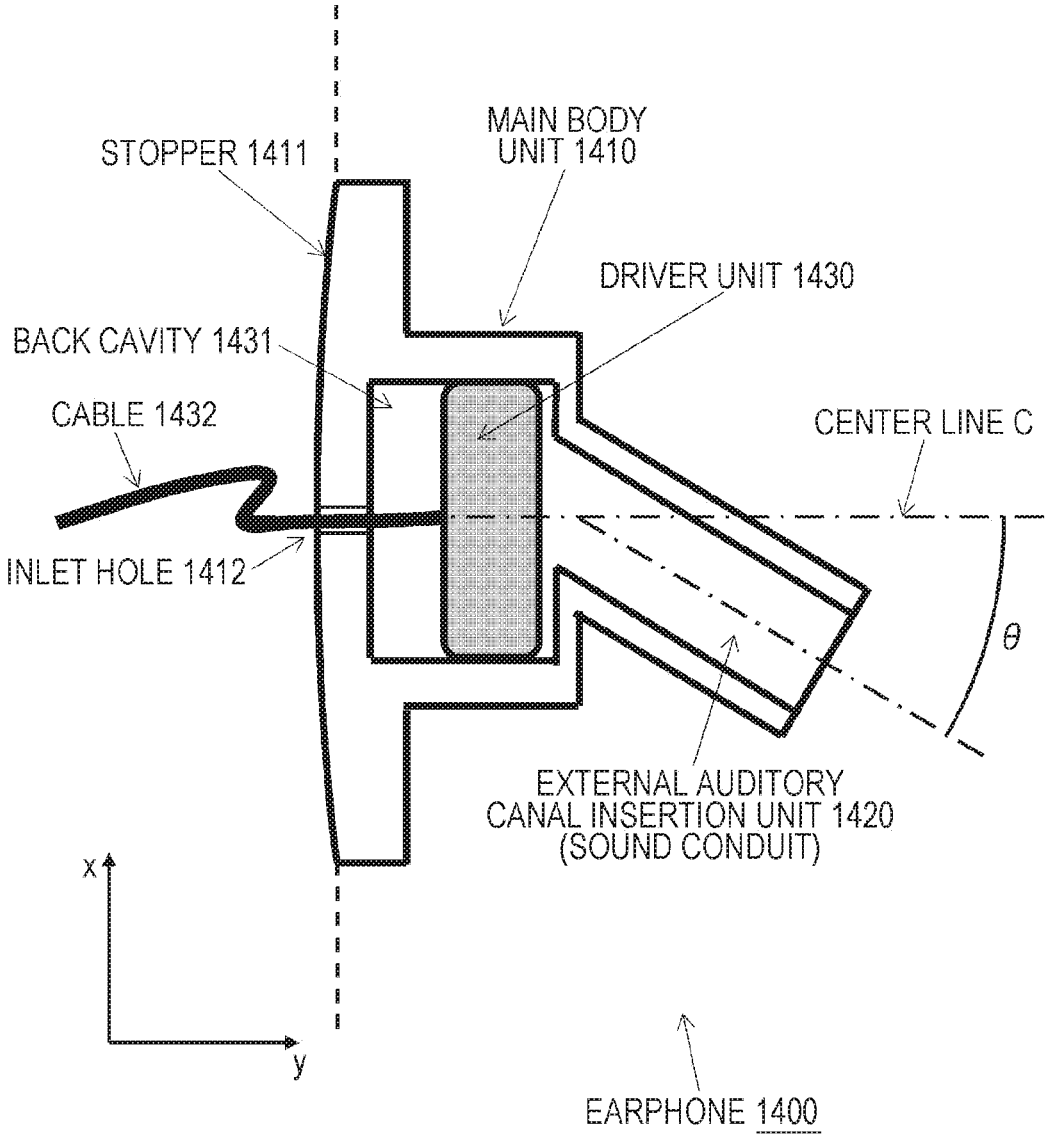
FIG. 14 is a cross-sectional view when an earphone 1400 to which the technology to be disclosed in the present description is applied is viewed from the X-Y plane.
Figure 15:
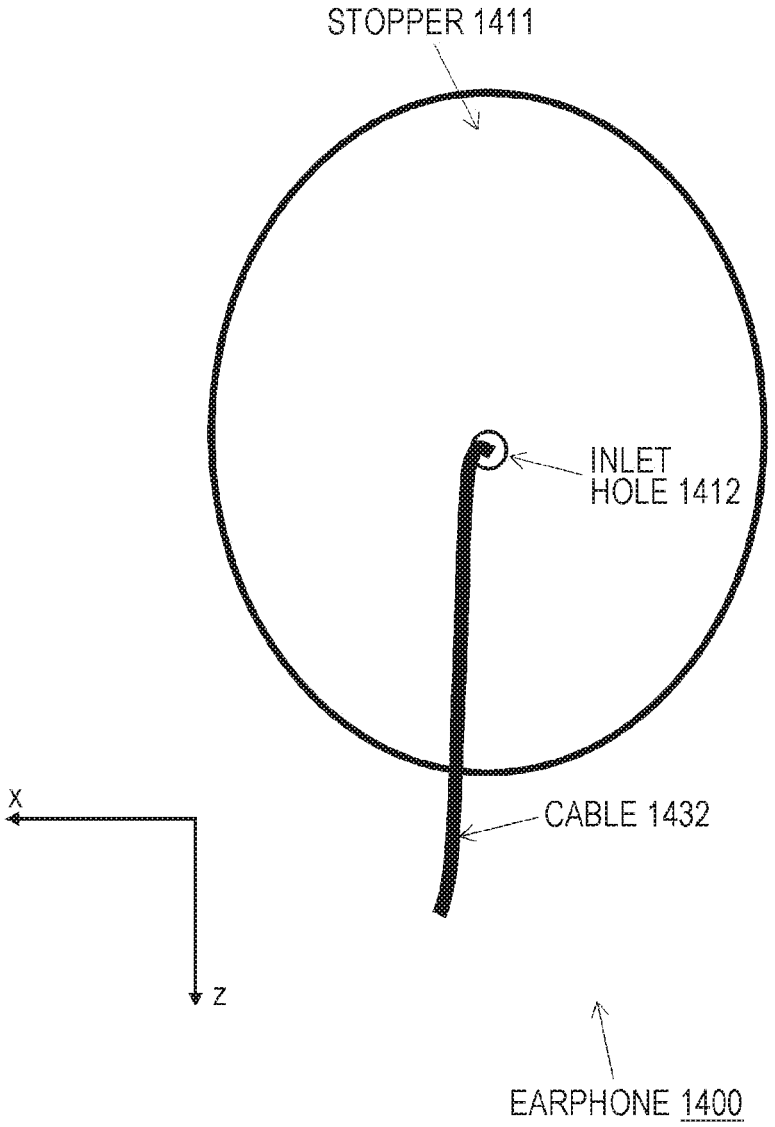
FIG. 15 is a back view when the earphone 1400 is viewed from the X-Z plane.
Figure 16:
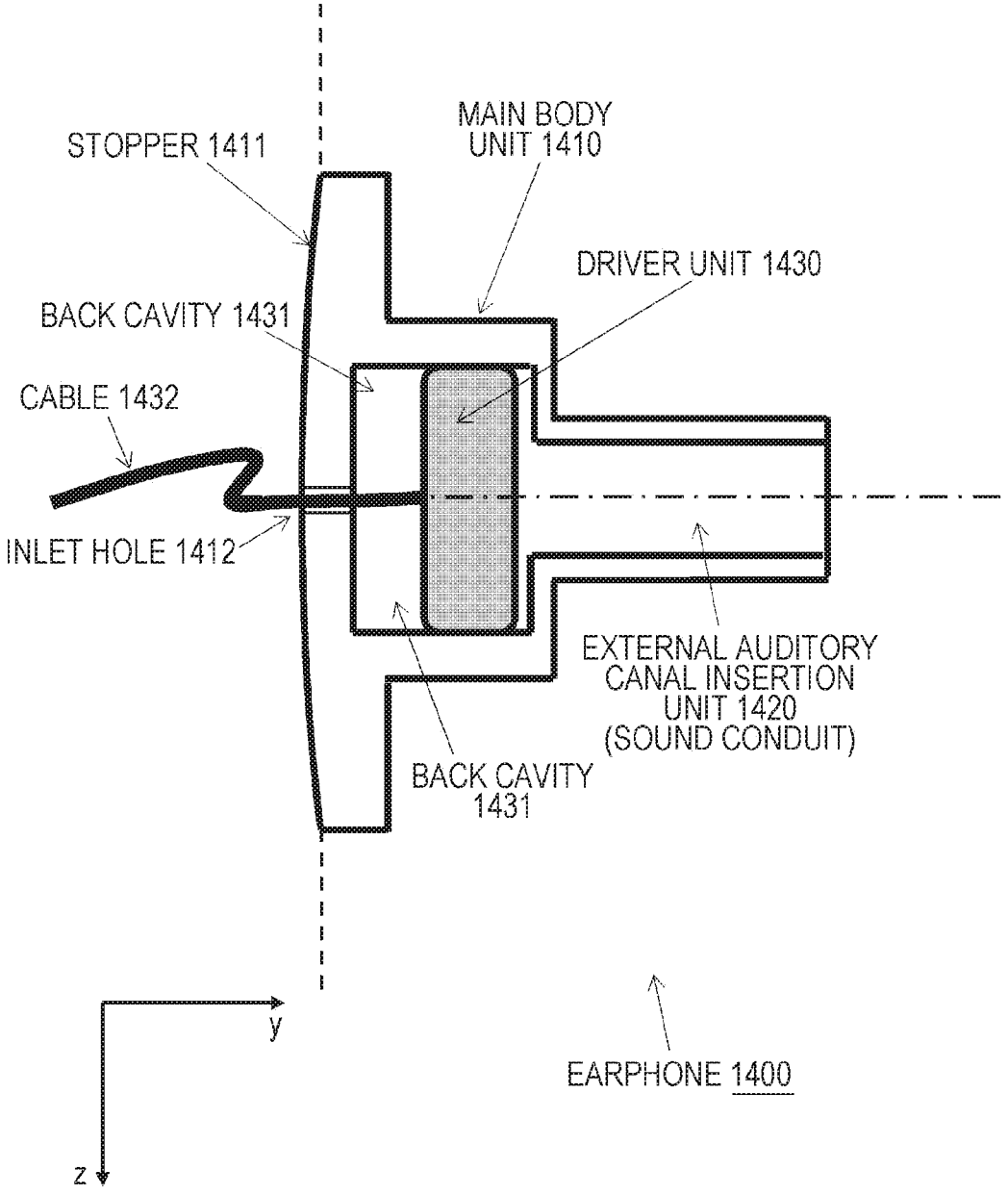
FIG. 16 is a cross-sectional view when the earphone 1400 is viewed from the Y-Z plane.

FIG. 14 to FIG. 16 schematically illustrate a configuration of an earphone 1400 to which the technology disclosed in the present description is applied. Note that, by defining the front-rear direction as the X axis, the left-right direction as the Y axis, and the up-down direction (not illustrated) as the Z axis when the earphone 1400 is worn on the left ear of a human, FIG. 14 illustrates a cross-sectional view when the earphone 1400 is viewed from the X-Y plane. Meanwhile, FIG. 15 illustrates a back view when the earphone 1400 is viewed from the X-Z plane. In addition, FIG. 16 illustrates a cross-sectional view when the earphone 1400 is viewed from the Y-Z plane.

The earphone 1400 is used while being inserted into a human ear (external auditory canal 100) and includes a main body unit 1410 substantially round column-shaped and a cylindrical external auditory canal insertion unit 1420 provided to protrude diagonally from a front surface of the main body unit 1410 (that is, an end surface closer to the eardrum 102). As in the in-the-ear device 300 illustrated in FIG. 1, the main body unit 1410 is inserted closer to the inside than the first curve 103 of the external auditory canal 100. Additionally, the external auditory canal insertion unit 1420 is disposed so as to be inclined at the center of the front surface of the main body unit 1410 toward a rear side (in a minus X direction) by a predetermined angle of inclination θ with respect to a center line C of the main body unit 1410 and a tip end thereof faces a direction for separating from the center line C. Furthermore, as in FIG. 6, the earphone 1400 includes an ear piece, while the external auditory canal insertion unit 1420 is inserted into the external auditory canal 100 with the ear piece interposed therebetween and also provided with an attachment groove formed thereon to fix the ear piece. Note that, for convenience, the illustration of the ear piece and the attachment groove is omitted in FIG. 14 and FIG. 16.

A driver unit 1430 is built in the main body unit 1410. The driver unit 1430 is typically constituted by a magnet, a voice coil, and a diaphragm, where the diaphragm having the voice coil is arranged within a magnetic circuit constituted by the magnet. The diaphragm is driven by a magnetic field generated in line with the audio signal input to the voice coil and then, a density state of the air in front of the diaphragm is changed such that a sound in accordance with the audio signal is output. In addition, the external auditory canal insertion unit 1420 is a member having a hollow cylindrical shape and also serves as a sound conduit to guide audio output from the driver unit 1430 out to a point just before the second curve 104 of the external auditory canal 100.

In the case of the earphone 1400, a sound pickup function is not included therein and thus, the effect of the resonance at the cavum conchae 232 is not necessary. Accordingly, a back surface of the main body unit 1410 does not need to have the shielding unit 811 (refer to FIG. 8) made flush with the cavum conchae 232. However, in order to block the earphone 1400 from being pushed into the inner section of the external auditory canal 100 deeper than necessary, a stopper 1411 shaped by making at least a portion of the back surface of the main body unit 1410 stick out from the external auditory canal entrance 101 in an XZ direction is disposed. In addition, by closing off the external auditory canal entrance 101, the stopper 1411 has a sound insulation effect that blocks a sound from entering from the external world. As a result, the audio output from the driver unit 1430 is not disturbed by an interference noise from the external world and the sound quality can be kept accordingly.

Figure 17:
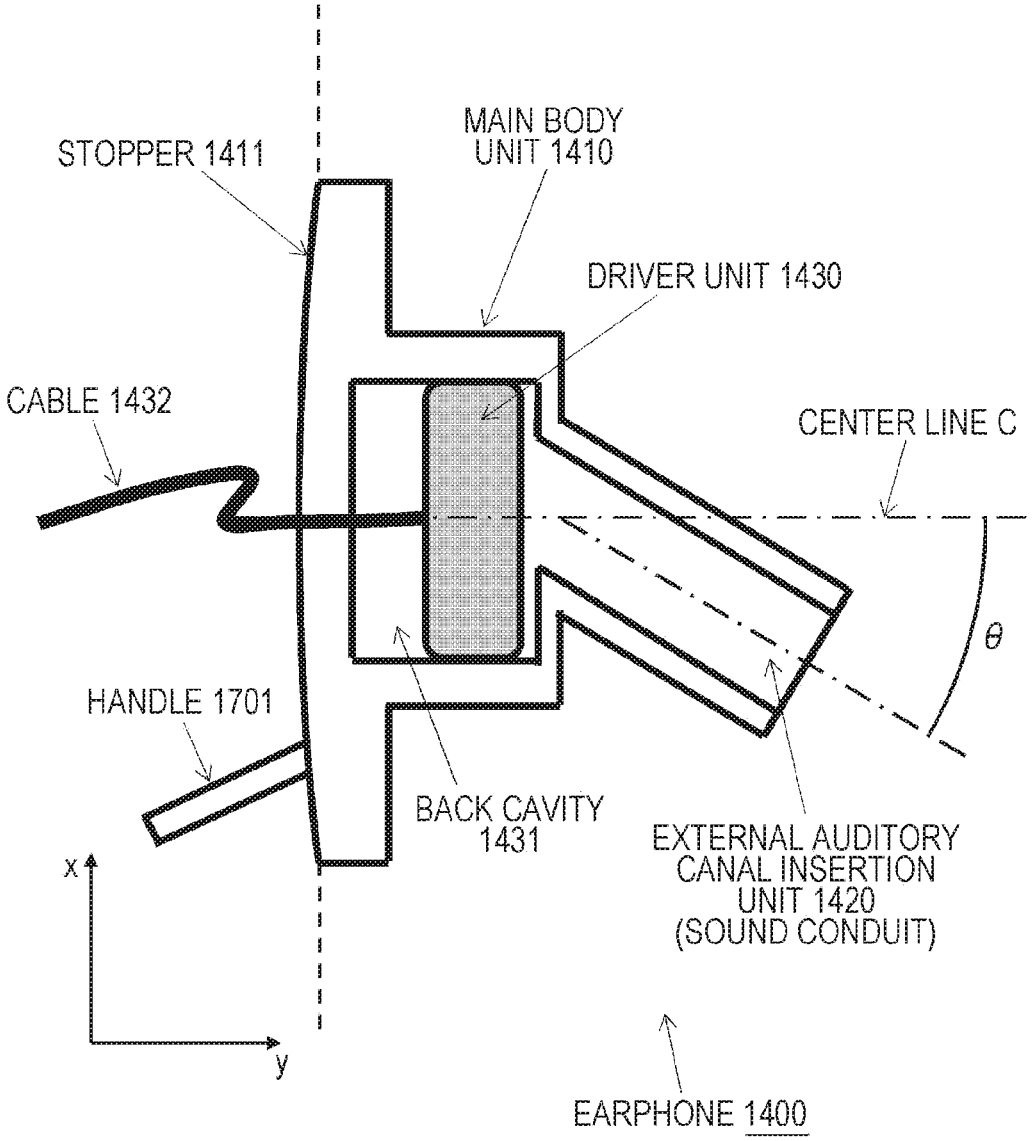
FIG. 17 is a view illustrating the earphone 1400 (variation) having a handle 1701 on a back surface.

Meanwhile, the back surface of the main body unit 1410 does not need to be configured as a plane flush with the cavum conchae 232 and can be arbitrarily shaped. Therefore, for example, a handle 1701 may be provided on the back surface of the main body unit 1410 as illustrated in FIG. 17. When a user puts on or puts off the earphone 1400 to or from the external auditory canal entrance 101, the work can be smoothly carried out by pinching the handle 1701.

A cable 1432 that transmits an audio signal from an external audio reproduction device (not illustrated) to the driver unit 1430 is configured as a shield cable. An audio output surface of the driver unit 1430 faces on an inner side, that is, toward the inner section of the external auditory canal 100. Therefore, as illustrated in FIG. 14 and FIG. 16, a terminal for connecting the cable 1432 can be attached to a back surface of the driver unit 1430. Meanwhile, the earphone 1400 does not have the sound pickup function and thus, it is not necessary to consider the influence of a sound disturbed by the cable 1432. For this reason, an inlet hole 1412 can be formed at an arbitrary place on the back surface of the main body unit 1410 such that the cable 1432 is inserted into the inside of the main body unit 1410. In the example illustrated in FIG. 15, the inlet hole 1412 is formed substantially at a center of the back surface of the main body unit 1410 (stopper 1411) and the cable 1432 is led to the inside of the main body unit 1410 so as to continue to a place where the driver unit 1430 is located. In addition, when the driver unit 1430 is disposed at an arbitrary place on the sound conduit, for example, on a tip end portion thereof, a back cavity 1431 of the driver unit 1430 can be made larger to enhance the sound quality.

Figure 18:
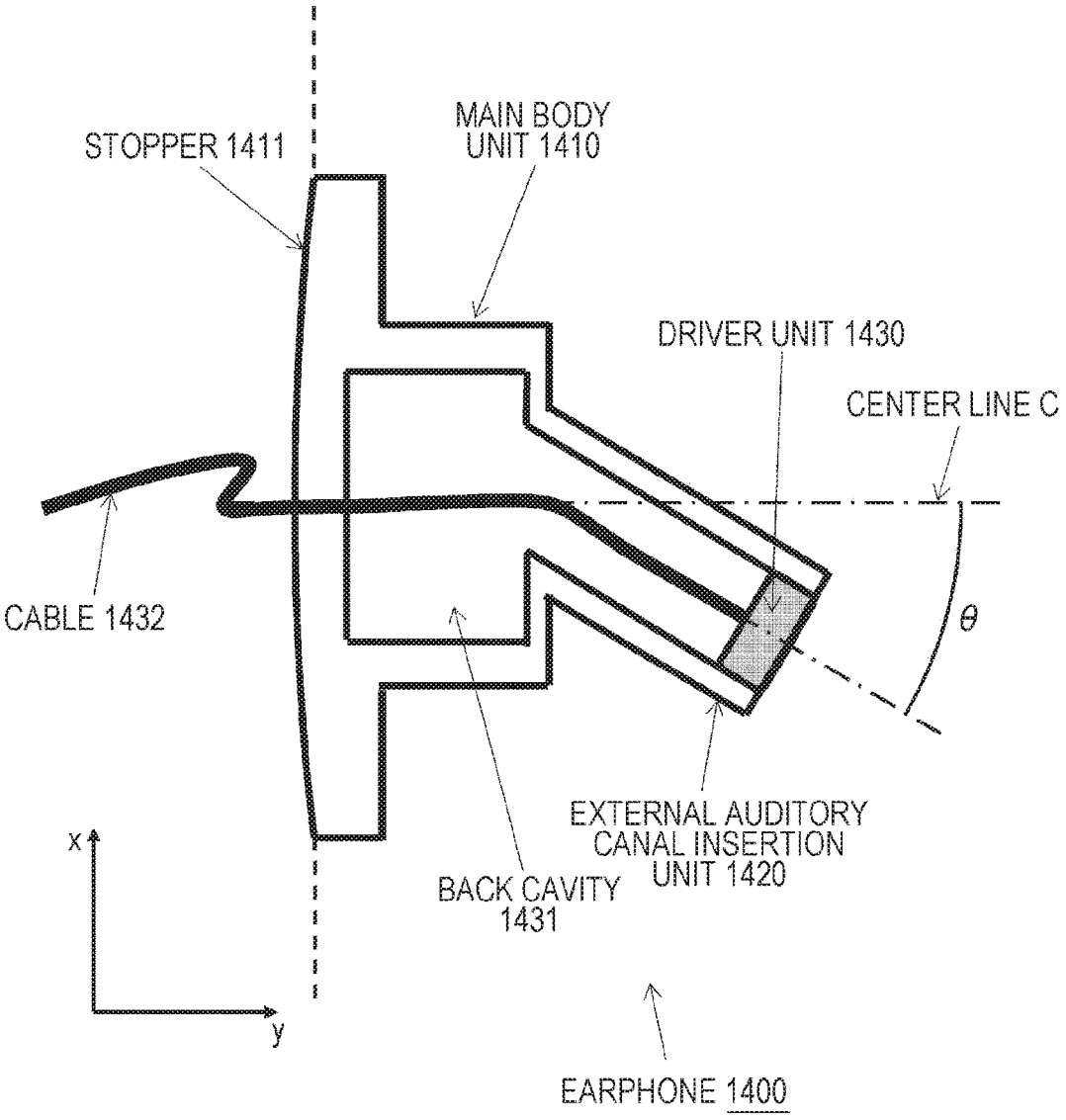
FIG. 18 is a cross-sectional view when the earphone 1400 (variation) is viewed from the X-Y plane.
Figure 19:
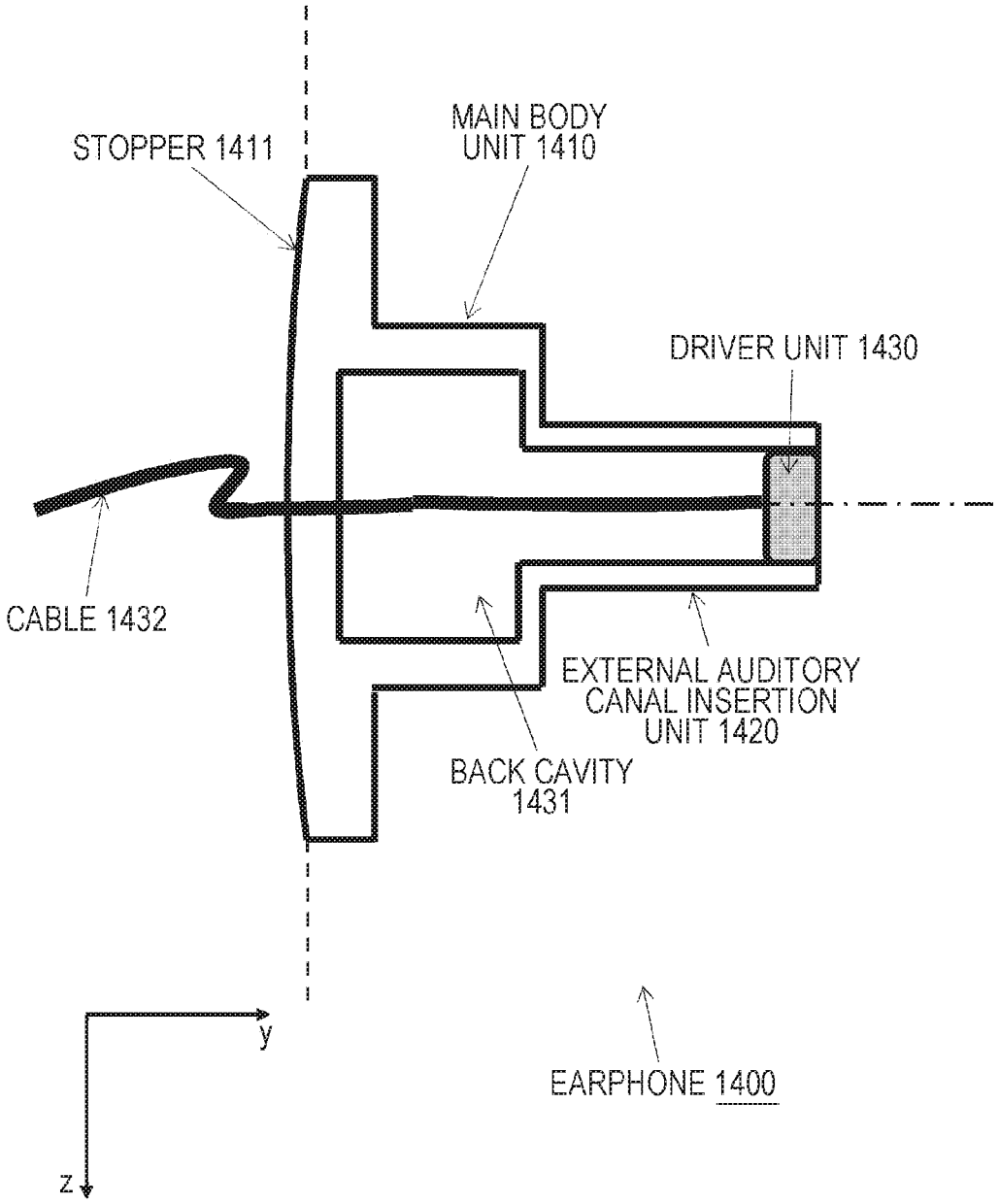
FIG. 19 is a cross-sectional view when the earphone 1400 (variation) is viewed from the Y-Z plane.

FIG. 18 and FIG. 19 illustrate a variation of the earphone 1400. Specifically, FIG. 18 illustrates a cross-sectional view when the earphone 1400 is viewed from the X-Y plane, whereas FIG. 19 illustrates a cross-sectional view when the earphone 1400 is viewed from the Y-Z plane. The illustration of the ear piece is omitted for convenience.

In the earphone 1400 according to this variation, as it is clear from FIG. 18 and FIG. 19, the driver unit 1430 configured so as to be compact is disposed at a tip end of the external auditory canal insertion unit 1420. This driver unit 1430 can be arranged closer to the eardrum 102 and accordingly, high quality audio can be provided with smaller output (that is, low power consumption). Unlike the exemplary configuration in which the driver unit 1430 is disposed in the main body unit 1410 as illustrated in FIG. 14 to FIG. 16, the external auditory canal insertion unit 1420 is not required to serve as the sound conduit. That is to say, as illustrated in FIG. 18 and FIG. 19, the main body unit 1410 and the external auditory canal insertion unit 1420 are configured so as to form an empty space such that a capacity of the back cavity 1431 is increased, whereby the sound quality can be further enhanced.

The points of the earphone 1400 according to the working example are as indicated below.

(1) The main body unit 1410, the driver unit 1430 built in the main body unit, the stopper 1411 disposed on the back surface of the main body unit 1410, and the sleeve-shaped external auditory canal insertion unit 1420 also serving as the sound conduit are provided.

(2) The stopper 1411 can be arbitrarily shaped and has at least a partial portion sticking out from the back surface of the main body unit 1410.

(3) The external auditory canal insertion unit 1420 also serving as the sound conduit is not orthogonal to the front surface of the main body unit 1410 and provided to protrude at a predetermined angle of inclination.

(4) The external auditory canal insertion unit 1420 also serving as the sound conduit is disposed at the center of the front surface of the main body unit 1410 or at a position offset in an opposite direction to a direction in which the external auditory canal insertion unit 1420 is inclined.

(5) Although the illustration has been omitted in FIG. 14 to FIG. 19, an end surface of the ear piece attached to the external auditory canal insertion unit 1420 is diagonally cut so as to be parallel to the front surface of the main body unit 1410 (refer to FIG. 6).

In the earphone 1400 according to the working example, the tip end of the sound conduit reaches near a point just before the second curve 104 and thus, the degree of sealing provided by the ear piece is increased, whereby an effect of blocking an interference noise from the external world is improved. In addition, because the degree of sealing provided by the ear piece is increased and the sound conduit arrives near a point just before the second curve 104, it is made possible to vibrate the eardrum 102 with lower power consumption.

Third Working Example

Figure 20:
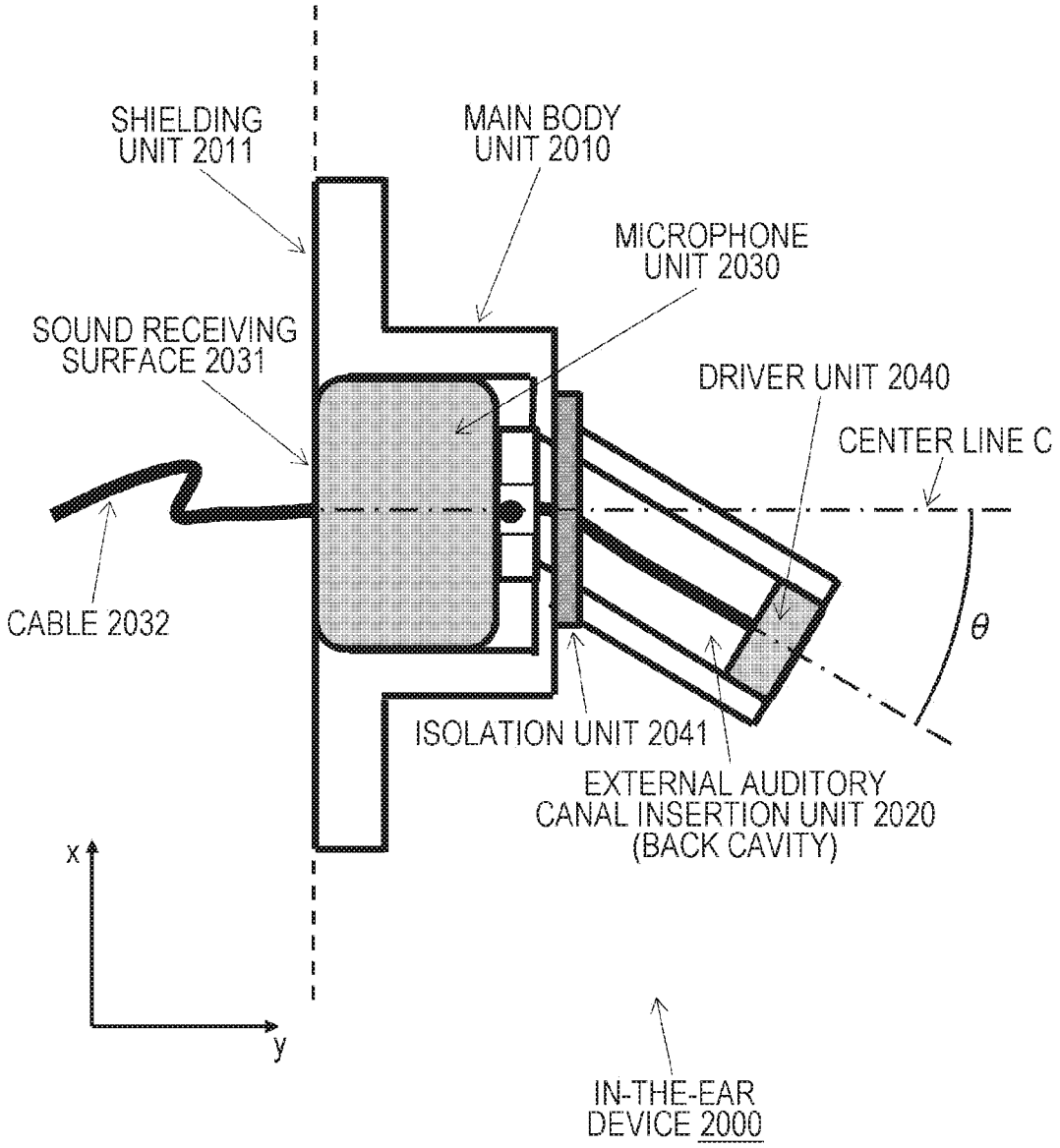
FIG. 20 is a cross-sectional view when an in-the-ear device 2000 configured by combining a binaural microphone and an earphone is viewed from the X-Y plane.
Figure 21:
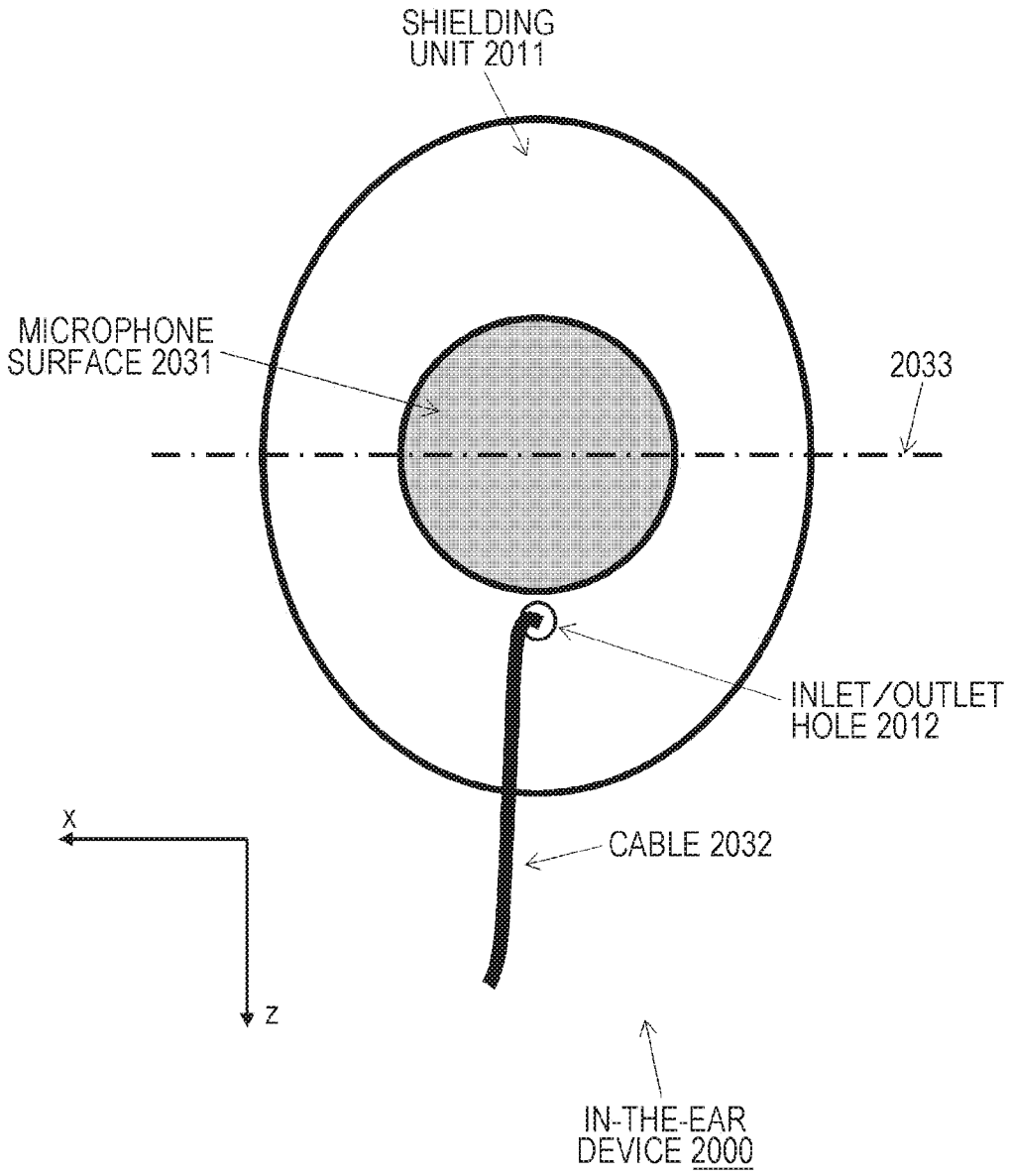
FIG. 21 is a back surface when the in-the-ear device 2000 is viewed from the X-Z plane.
Figure 22:
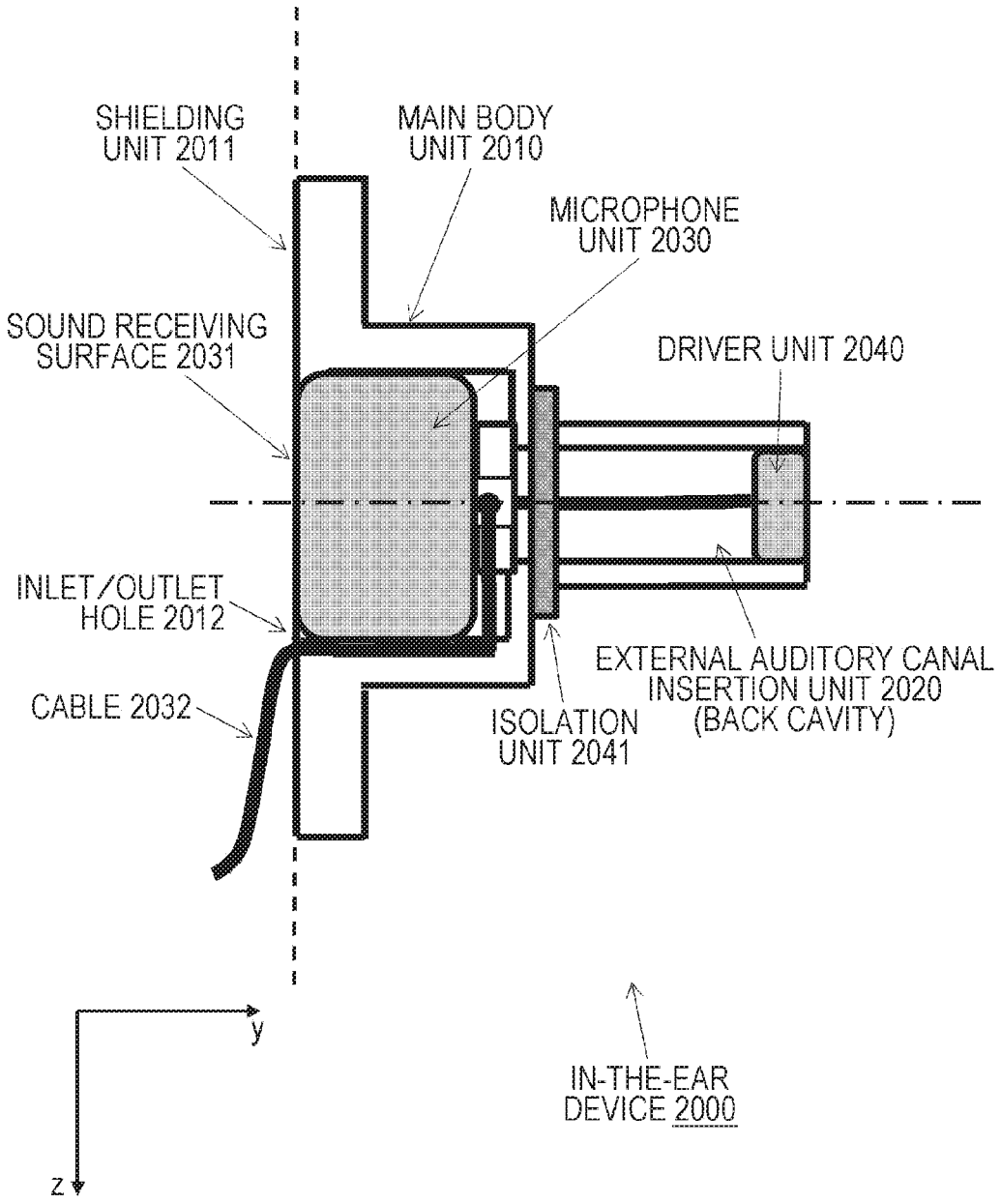
FIG. 22 is a cross-sectional view when the in-the-ear device 2000 is viewed from the Y-Z plane.

FIG. 20 to FIG. 22 schematically illustrate a configuration of an in-the-ear device 2000 configured by combining a binaural microphone and an earphone. Note that, by defining the front-rear direction as the X axis, the left-right direction as the Y axis, and the up-down direction (not illustrated) as the Z axis when the in-the-ear device 2000 is worn on the left ear of a human, FIG. 20 illustrates a cross-sectional view when the in-the-ear device 2000 is viewed from the X-Y plane. Meanwhile, FIG. 21 illustrates a back view when the in-the-ear device 2000 is viewed from the X-Z plane. In addition, FIG. 22 illustrates a cross-sectional view when the in-the-ear device 2000 is viewed from the Y-Z plane.

The in-the-ear device 2000 has a configuration to which the technology disclosed in the present description is applied. Specifically, the in-the-ear device 2000 is used while being inserted into a human ear (external auditory canal 100) and includes a main body unit 2010 substantially round column-shaped and a cylindrical external auditory canal insertion unit 2020 provided to protrude diagonally from a front surface of the main body unit 2010 (that is, an end surface closer to the eardrum 102). As in the in-the-ear device 300 illustrated in FIG. 1, the main body unit 2010 is inserted closer to the inside than the first curve 103 of the external auditory canal 100. Additionally, the external auditory canal insertion unit 2020 is disposed so as to be inclined at the center of the front surface of the main body unit 2010 toward a rear side (in a minus X direction) by a predetermined angle of inclination θ with respect to a center line C of the main body unit 2010 and a tip end thereof faces a direction for separating from the center line C. Furthermore, as in FIG. 6, the in-the-ear device 2000 includes an ear piece, while the external auditory canal insertion unit 2020 is inserted into the external auditory canal 100 with the ear piece interposed therebetween and also provided with an attachment groove formed thereon to fix the ear piece. Note that, for convenience, the illustration of the ear piece and the attachment groove is omitted in FIG. 20 and FIG. 22.

The in-the-ear device 2000 configured by combining the binaural microphone and the earphone is capable of operating as a noise-cancelling type earphone. Specifically, a noise at the outside is picked up with a microphone and an antiphase sound to the noise is superimposed on an original audio signal such as music to be output from an earphone, thereby reducing the noise (for example, refer to Patent Document 2).

A microphone unit 2030 is built in the main body unit 2010. When the in-the-ear device 2000 is worn on the human ear, a sound receiving surface 2031 configured to pick up a sound is required to face the outside. For this reason, in the working example, the sound receiving surface 2031 of the microphone unit 2030 is in contact with the external world on a back surface side of the main body unit 2010, namely, a side opposing the external auditory canal insertion unit 2020 as illustrated in FIG. 20 to FIG. 22.

In addition, a shielding unit 2011 is set so as to stick out even slightly from the back surface of the main body unit 2010. This shielding unit 2011 is required to be flush with the sound receiving surface 2031. With this, an effect of shielding from a noise from the external world can be enhanced. Compared to this, when sufficient shielding from a sound is not provided by the shielding unit 2011, the noise from the external world resonates in the external auditory canal 100 and additionally reflected therein to disturb the sound input to the sound receiving surface 2031. Consequently, an accurate head-related transfer function can no longer be measured. The shielding unit 2011 has a size larger than that of the external auditory canal entrance 101 to also play a role as a stopper for blocking the compact in-the-ear device 2000 from being pushed into the inner section of the external auditory canal 100 deeper than necessary.

Meanwhile, the driver unit 2040 is disposed at a tip end portion of the external auditory canal insertion unit 2020. The driver unit 2040 is constituted by a magnet, a voice coil, and a diaphragm, where the diaphragm having the voice coil is arranged within a magnetic circuit constituted by the magnet. The diaphragm is driven by a magnetic field generated in line with the audio signal input to the voice coil and then, a density state of the air in front of the diaphragm is changed such that a sound in accordance with the audio signal is output.

As illustrated in the drawing, the driver unit 2040 can be arranged closer to the eardrum 102 at a tip end of the external auditory canal insertion unit 2020 and accordingly, high quality audio can be provided with smaller output (that is, low power consumption). Although it is not necessary to configure the external auditory canal insertion unit 2020 as the sound conduit, as illustrated in FIG. 20 and FIG. 22, when an empty space is provided in the external auditory canal insertion unit 2020 and the main body unit 2010 located on a rear side of the driver unit 2040 such that a capacity of the back cavity is increased, it is possible to further enhance the sound quality.

In addition, as illustrated in FIG. 20 and FIG. 22, the main body unit 2010 and the external auditory canal insertion unit 2020 are coupled to each other with an isolation unit 2041 interposed therebetween. The isolation unit 2041 is constituted by a material having a different acoustic impedance such as resin, brass, or lead and configured to block the sound propagation between the microphone unit 2030 and the driver unit 2040.

A cable 2032 that transmits an audio signal obtained through the sound pickup by the microphone unit 2030 to the outside and also transmits an audio signal from an external audio reproduction device (not illustrated) to the driver unit 2040 is configured as a shield cable. As illustrated in FIG. 22, the cable 2032 is inserted through an inlet/outlet hole 2012 formed on the shielding unit 2011 from an opposite side of the sound receiving surface 2031 via the inside of the main body unit 2010 or a gap between the main body unit 2010 and the microphone unit 2030 so as to communicate with the outside of the external auditory canal 100. As illustrated in FIG. 21, it is preferable that the inlet/outlet hole 2012 be disposed lower than a horizontal line 2033 passing through a center of the sound receiving surface 2031. With this, it is possible to prevent an adverse influence that disturbs a sound input to the sound receiving surface 2031 due to the influence of the cable 2032 as in a case where the cable 2032 hanging down touches the sound receiving surface 2031.

Figure 23:
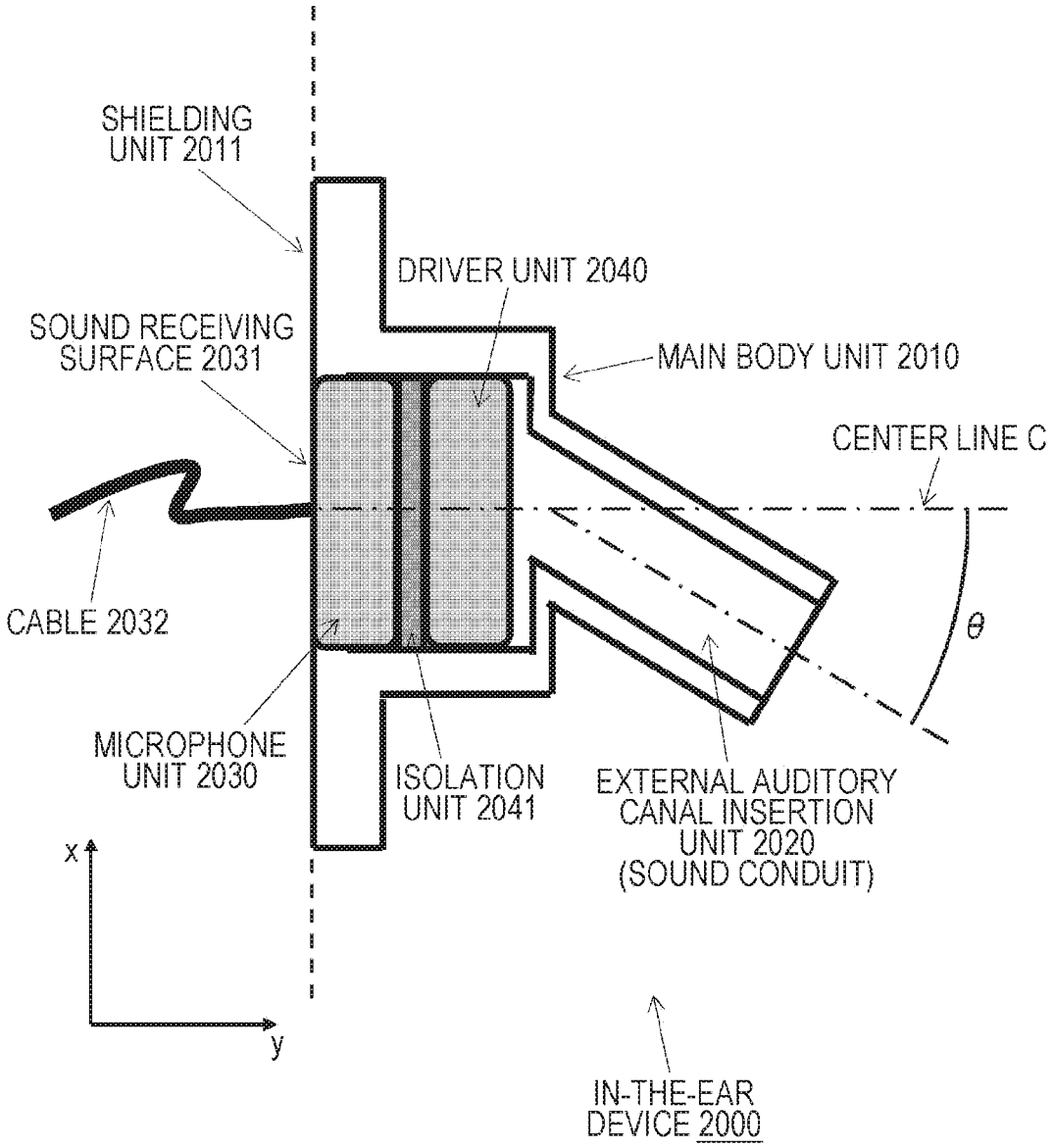
FIG. 23 is a cross-sectional view when the in-the-ear device 2000 (variation) is viewed from the X-Y plane.
Figure 24:
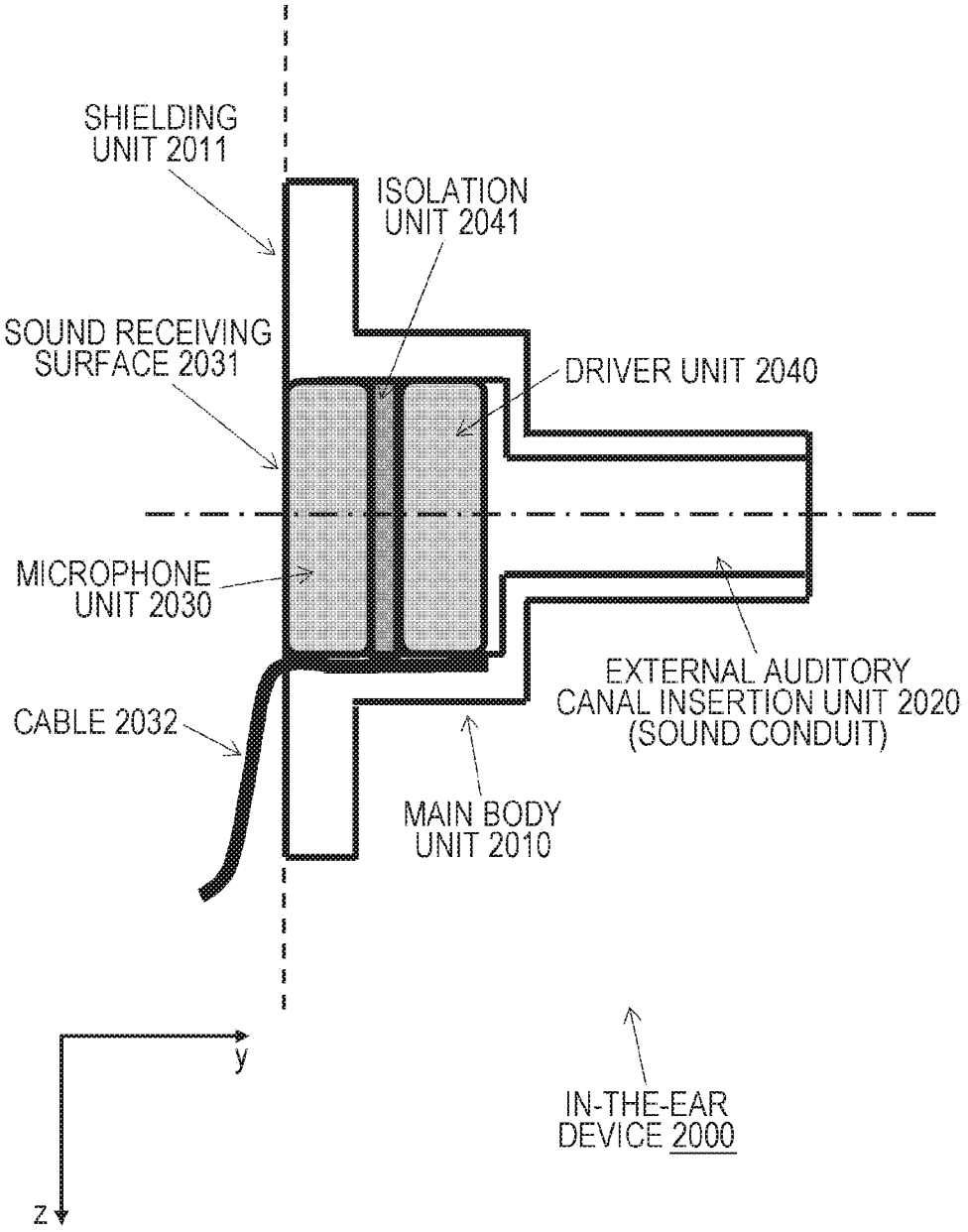
FIG. 24 is a cross-sectional view when the in-the-ear device 2000 (variation) is viewed from the Y-Z plane.

FIG. 23 and FIG. 24 illustrate a variation of the in-the-ear device 2000. Specifically, FIG. 23 illustrates a cross-sectional view when the in-the-ear device 2000 is viewed from the X-Y plane, whereas FIG. 24 illustrates a cross-sectional view when the in-the-ear device 2000 is viewed from the Y-Z plane. The illustration of the ear piece is omitted for convenience.

In the in-the-ear device 2000 according to this variation, as it is clear from FIG. 23 and FIG. 24, the driver unit 2040 along with the microphone unit 2030 is built in the main body unit 2010. When the in-the-ear device 2000 is worn on the human ear, a sound receiving surface 2031 configured to pick up a sound is required to face the outside. For this reason, the driver unit 2040 and the microphone unit 2030 are arranged in this order from an inner side of the external auditory canal 100 and also configured such that the sound receiving surface 2031 of the microphone unit 2030 is in contact with the external world on the back surface side of the main body unit 2010. In addition, the external auditory canal insertion unit 2020 is a member having a hollow cylindrical shape and also serves as a sound conduit to guide audio output from the driver unit 2040 out to a point just before the second curve 104 of the external auditory canal 100.

Meanwhile, the microphone unit 2030 and the driver unit 2040 are coupled to each other with the isolation unit 2041 interposed therebetween. The isolation unit 2041 is constituted by a material having a different acoustic impedance such as resin, brass, or lead and configured to block the sound propagation between the microphone unit 2030 and the driver unit 2040.

The in-the-ear device 2000 according to the working example is provided with both of the functions as the binaural microphone and the earphone. In addition to this, when the functions as the binaural microphone and the earphone coexist, the following effects can be obtained.

(1) Because the microphone is located near the external auditory canal entrance 101, an error relative to a sound arriving at the eardrum 102 is extremely reduced and accordingly, the cancelling effect by a noise-cancelling headphone can be enhanced.

(2) Monitoring during the binaural sound recording is enabled. For example, it is possible to enjoy a performance in a live music venue while a high-precision binaural sound recording is being carried out.

CITATION LIST

Patent Document

Patent Document 1: Japanese Patent Application Laid-Open No. 2007-189468

Patent Document 2: Japanese Patent Application Laid-Open No. 2013-42218

Non-Patent Document

Non-patent Document 1: Klaus A J Riederer, "Part IVa: Effect of Cavum Conchae Blockage on Human. Head-Related Transfer Functions" (18th Itern. Congress on Acoustics. Kyoto, Japan, pp. 787-790, 2004)

INDUSTRIAL APPLICABILITY

The technology disclosed in the present description has been described thus far in detail with reference to specific embodiments. However, it is self-evident that modification and substitution of the embodiments can be made by a person skilled in the art without departing from the spirit of the technology disclosed in the present description.

The present description has focused on the description of the embodiments in which the technology disclosed in the present description is applied to the binaural microphone or the earphone. However, the spirit of the technology disclosed in the present description is not limited thereto. For example, the technology disclosed in the present description can be similarly applied to various in-the-ear type devices including a hearing aid and an ear thermometer.

In conclusion, the technology disclosed in the present description has been described in a form of examples and the content described in the present description should not be narrowly construed. In order to judge the spirit of the technology disclosed in the present description, claims should be considered.

Furthermore, the technology disclosed in the present description can be configured as follows.

(1) An in-the-ear device including:

a main body unit configured to be inserted closer to the inside than a first curve of an external auditory canal and having a back surface that forms a surface substantially same as a surface of a cavum conchae; and an external auditory canal insertion unit provided to protrude toward an inner section of the external auditory canal from a front surface of the main body unit.

(2) The in-the-ear device according to the aforementioned (1), in which the external auditory canal insertion unit is disposed at a center of the front surface of the main body unit or a position offset toward a front side from the center of the front surface.

(3) The in-the-ear device according to the aforementioned (2), in which the external auditory canal insertion unit is disposed so as to be inclined toward a rear side by a predetermined angle of inclination with respect to a center line of the main body unit.

(4) The in-the-ear device according to the aforementioned (3), further including an ear piece attached to the external auditory canal insertion unit.

(5) The in-the-ear device according to the aforementioned (4), in which an end surface of the ear piece is diagonally cut in accordance with the predetermined angle of inclination so as to be parallel to the front surface of the main body unit.

(6) The in-the-ear device according to any one of the aforementioned (1) to (5), further including a microphone unit within the main body unit.

(7) The in-the-ear device according to the aforementioned (6), in which a sound receiving surface of the microphone unit is in contact with an external world on a back surface side of the main body unit.

(8) The in-the-ear device according to the aforementioned (7), further including a shielding unit, at least a portion of which sticks out from the back surface of the main body unit.

(9) The in-the-ear device according to the aforementioned (8), in which the shielding unit is flush with the sound receiving unit.

(10) The in-the-ear device according to the aforementioned (8) or (9), in which a cable that transmits an audio signal obtained through the sound pickup by the microphone unit to the outside is inserted through an outlet hole formed on the shielding unit from an opposite side of the sound receiving surface and then discharged to the outside of the external auditory canal via the inside of the main body unit or a gap between the main body unit and the microphone unit.

(11) The in-the-ear device according to the aforementioned (10), in which the outlet hole is disposed lower than a horizontal line passing through a center of the sound receiving surface.

(12) The in-the-ear device according to any one of the aforementioned (1) to (5), further including a driver unit within the main body unit, in which the external auditory canal insertion unit includes a sound conduit.

(13) The in-the-ear device according to the aforementioned (12), further including a stopper, at least a portion of which sticks out from the back surface of the main body unit.

(13-1) The in-the-ear device according to the aforementioned (12) or (13), further including a handle on the back surface of the main body unit.

(14) The in-the-ear device according to any one of the aforementioned (1) to (5), further including a driver unit in the external auditory canal insertion unit.

(14-1) The in-the-ear device according to the aforementioned (14), in which the driver unit is attached to a tip end of the external auditory canal insertion unit, the in-the-ear device further including a back cavity at a rear side of the driver unit, which is obtained by forming an empty space in the external auditory canal insertion unit.

(15) The in-the-ear device according to any one of the aforementioned (1) to (5), further including a microphone unit and a driver unit.

(15-1) The in-the-ear device according to the aforementioned (15), further including an isolation unit between the microphone unit and the driver unit, which is made of a material having a different acoustic impedance.

(16) The in-the-ear device according to the aforementioned (15), in which the microphone unit is disposed within the main body unit and the driver unit is disposed at a tip end of the external auditory canal insertion unit.

(16-1) The in-the-ear device according to the aforementioned (16), further including a back cavity at a rear side of the driver unit, which is obtained by forming an empty space in the external auditory canal insertion unit.

(17) The in-the-ear device according to the aforementioned (15), in which the driver unit and the microphone unit are arranged within the main body unit in this order from an inner side of the external auditory canal, and the external auditory canal insertion unit includes a sound conduit.

(18) The in-the-ear device according to any one of the aforementioned (15) to (17), in which a sound receiving surface of the microphone unit is in contact with an external world on a back surface side of the main body unit.

(19) The in-the-ear device according to any one of the aforementioned (15) to (18), further including a shielding unit, at least a portion of which sticks out from the back surface of the main body unit.

(20) The in-the-ear device according to any one of the aforementioned (15) to (19), in which a cable that transmits an audio signal obtained through the sound pickup by the microphone unit to the outside or transmits an audio signal to be input to the driver unit is inserted by way of an inlet/outlet hole disposed lower than a horizontal line passing through a center of the sound receiving surface.

REFERENCE SIGNS LIST

300 In-the-ear device
310 Main body unit
320 External auditory canal insertion unit
321 Attachment groove
600 Ear piece
800 Binaural microphone
810 Main body unit
811 Sound blocking unit
812 Outlet hole
820 External auditory canal insertion unit
830 Microphone unit
831 Sound receiving surface
832 Cable
1400 Earphone
1410 Main body unit
1411 Stopper
1412 Inlet hole
1420 External auditory canal insertion unit
1430 Driver unit
1432 Cable
1701 Handle
2000 In-the-ear device
2010 Main body unit
2011 Shielding unit
2020 External auditory canal insertion unit
2030 Microphone unit
2031 Sound receiving surface
2032 Cable
2040 Driver unit
2041 Isolation unit
2500 Ear piece

The invention claimed is:

1. An in-the-ear device, comprising:

a main body unit configured to be inserted closer to an inside of an external auditory canal than a curve of the external auditory canal, wherein the main body unit comprises a back surface that is substantially same as a surface of a cavum conchae;

an external auditory canal insertion unit configured to protrude towards an inner section of the external auditory canal from a front surface of the main body unit;

a shielding unit that protrudes from the back surface of the main body unit such that the shielding unit is larger than an entrance of the external auditory canal;

a microphone unit comprising a sound receiving surface, wherein the microphone unit is configured to receive a first audio signal; and a cable configured to transmit the first audio signal to an outside of the external auditory canal, wherein the cable is inserted through an outlet hole, on the shielding unit, from an opposite side of the sound receiving surface, and the cable is discharged to the outside of the external auditory canal via one of an inside of the main body unit or a gap between the main body unit and the microphone unit.

2. The in-the-ear device according to claim 1, wherein the external auditory canal insertion unit is at one of a center of the front surface of the main body unit or a position offset from the center of the front surface.

3. The in-the-ear device according to claim 2, wherein the external auditory canal insertion unit is inclined by a specific angle of inclination with respect to a center of the main body unit.

4. The in-the-ear device according to claim 1, wherein the shielding unit is flush with the sound receiving surface.

5. The in-the-ear device according to claim 1, wherein the outlet hole, on the shielding unit, is lower than a center of the sound receiving surface.

6. The in-the-ear device according to claim 1, wherein the external auditory canal insertion unit includes a sound conduit.

7. The in-the-ear device according to claim 1, further comprising a driver unit in the external auditory canal insertion unit.

8. The in-the-ear device according to claim 7, wherein the driver unit is at a tip end of the external auditory canal insertion unit.

9. The in-the-ear device according to claim 1, wherein the main body unit further comprises a driver unit.

10. The in-the-ear device according to claim 1, further comprising:

a driver unit, wherein the microphone unit is further configured to receive a second audio signal, and the cable is further configured to transmit the second audio signal to the driver unit.

11. A device, comprising:

a main body unit configured to be inserted closer to an inside of an external auditory canal than a curve of the external auditory canal, wherein the main body unit comprises:

a back surface that is substantially same as a surface of a cavum conchae; and a microphone unit configured to obtain an audio signal, a sound receiving surface of the microphone unit is in contact with an external world on a back side of the main body unit;

an external auditory canal insertion unit configured to protrude towards an inner section of the external auditory canal from a front surface of the main body unit;

a shielding unit, wherein at least a portion of the shielding unit sticks out from the back surface of the main body unit; and a cable configured to transmit the audio signal to an outside of the external auditory canal, wherein the cable is inserted through an outlet hole, on the shielding unit, from an opposite side of the sound receiving surface, and the cable is discharged to the outside of the external auditory canal via one of an inside of the main body unit, or a gap between the main body unit and the microphone unit.

* * * * *